US008007072B2

(12) United States Patent
Nishi et al.

(10) Patent No.: US 8,007,072 B2
(45) Date of Patent: Aug. 30, 2011

(54) CLEANING BLADE, METHOD OF FABRICATING CLEANING BLADE, AND CLEANING APPARATUS FOR LIQUID DISCHARGE HEAD

(75) Inventors: Shota Nishi, Kanagawa (JP); Shigeyoshi Fujiki, Kanagawa (JP); Manabu Matsuda, Kanagawa (JP); Yuji Yakura, Kanagawa (JP); Makoto Ando, Tokyo (JP)

(73) Assignee: Sony Corporation, Tokyo (JP)

( * ) Notice: Subject to any disclaimer, the term of this patent is extended or adjusted under 35 U.S.C. 154(b) by 1099 days.

(21) Appl. No.: 11/716,882

(22) Filed: Mar. 12, 2007

(65) Prior Publication Data

US 2007/0222816 A1 Sep. 27, 2007

(30) Foreign Application Priority Data

Mar. 27, 2006 (JP) ..... P2006-085986

(51) Int. Cl.
*B41J 2/165* (2006.01)

(52) U.S. Cl. ..... 347/33; 347/22

(58) Field of Classification Search ..... 347/22, 347/29, 30, 32, 33, 34
See application file for complete search history.

(56) References Cited

U.S. PATENT DOCUMENTS

| | | | | |
|---|---|---|---|---|
| 5,065,158 | A * | 11/1991 | Nojima et al. | 347/33 |
| 5,621,450 | A * | 4/1997 | Kawai et al. | 347/108 |
| 6,688,722 | B2 * | 2/2004 | Uchida et al. | 347/33 |
| 7,077,498 | B2 * | 7/2006 | Nagase | 347/33 |

FOREIGN PATENT DOCUMENTS

| | | | | |
|---|---|---|---|---|
| JP | 55-034969 | | 2/1982 | |
| JP | 03-215043 | | 9/1991 | |
| JP | 406071904 | A * | 3/1994 | 347/33 |
| JP | 2001-010072 | | 1/2001 | |
| JP | 2002-067338 | | 3/2002 | |
| JP | 2003-291360 | | 10/2003 | |
| JP | 2005-153182 | | 6/2005 | |

* cited by examiner

*Primary Examiner* — Juanita D Stephens
(74) *Attorney, Agent, or Firm* — Robert J. Depke; Rockey, Depke & Lyons, LLC

(57) ABSTRACT

A cleaning blade which wipes a liquid discharge area by being moved relatively with respect to the liquid discharge area of a liquid discharge head having the liquid discharge area in which liquid discharge nozzles are arranged to discharge a liquid is disclosed. The cleaning blade includes: a supporting plate which has an adhesive agent layer on its front surface; and a wipe part which is slid and contacted with the liquid discharge area, the wipe part formed in which an elastic part formed of a synthetic resin is formed in one piece on the adhesive agent layer, and a tip end thereof is cut in a predetermined shape.

8 Claims, 31 Drawing Sheets

CLEANING BLADE, METHOD OF FABRICATING CLEANING BLADE, AND CLEANING APPARATUS FOR LIQUID DISCHARGE HEAD

CROSS REFERENCES TO RELATED APPLICATIONS

The present invention contains subject matter related to Japanese Patent Application JP 2006-085986 filed in the Japanese Patent Office on Mar. 27, 2006, the entire contents of which being incorporated herein by reference.

BACKGROUND OF THE INVENTION

1. Field of the Invention

The present invention relates to a liquid discharge apparatus which discharges a liquid onto a target object from a liquid discharge nozzle formed on a liquid discharge head, particularly to a cleaning blade which cleans a liquid discharge head.

2. Description of the Related Art

An image forming apparatus in an ink jet printing system such as an ink jet printer is widely available in that its running costs are inexpensive and it is easy to print color images and to reduce the apparatus size. The ink jet printer is configured in which a very small quantity of ink is discharged from fine ink discharge nozzles arranged in an ink discharge area of a print head to record an image. In this type of ink jet printer, when it does not continuously operate to print for a long time and ink is not discharged from the ink discharge nozzles of the print head, the ink attached near the ink discharge nozzle in the ink discharge area due to the previous print operation sometimes evaporates, dries, thickens and hardens, causing the difficulty in normal ink discharge.

On this account, in traditional manners, a print head is cleaned in which a slightly hard rubber blade is pressed against the ink discharge area of the print head, and the blade is slid over the ink discharge area to wipe off the ink attached, thickened and hardened. In connection therewith, a technique is disclosed in which a plurality of blades is mounted on a shaft and rotated to further enhance the wiping effect (see JP-A-57-34969 (Patent Reference 1)).

In the cleaning of the print head using these blades, the flatness and the stiffness of a wiping member of the blade which rubs the ink discharge area of the print head affects the cleaning effect. More specifically, when the tip end area of the wiping member is not formed flat, even though the ink discharge area of the print head is rubbed, it is difficult to sufficiently wipe off thickened ink and waste such as paper dust attached to the ink discharge area. Furthermore, when the stiffness of the wiping member is not retained in the entire length touched to the ink discharge area, the wiping member slides over the ink discharge area at a predetermined pressure, deformation generated in the wiping member is unstable, and the wiping performance is unstable depending on the places in the wiping member.

Contrary to a serial scan head printing apparatus in which a print head provided with an ink discharge nozzle forms an image while it is moving in the print span direction of paper, particularly in a so-called line scan head printing apparatus in which ink discharge nozzles are arranged as matched with the print span of a paper sheet without moving a print head, the length in the print span direction of an ink discharge area of the print head in a nearly rectangular is also longer than that of the serial scan head printing apparatus. Therefore, in the line scan head printing apparatus, since the blade for cleaning the ink discharge area of the print head is longer as well, it is demanded that the flatness of the tip end of the wiping member is accurately secured in the entire length, and that the stiffness is secured as well. Furthermore, it is also demanded that the mounting accuracy is attained to mount such a long blade as it faces the print head.

Traditionally, this type of blade is fabricated in which a synthetic resin is cast into a predetermined mold for molding, it is punched out to form a wiping member, a supporting plate is perforated with a mounting hole for supporting the wiping member, and then the wiping member is mounted on the supporting plate formed of a metal or resin plate.

However, two corners in sectional form of the tip end of the wiping member to rub the ink discharge area are sometimes rounded, causing deteriorated cleaning performance of the ink discharge area in the width direction. Furthermore, for the distance between the mounting hole formed in the wiping member and the tip end part of the wiping member to be rubbed over the ink discharge area and for the flatness and the stiffness of the tip end part, the wiping member is demanded to have high accuracy in the entire length in the longitudinal direction. However, the stiffness of the wiping member is deteriorated when the wiping member is punched out, it tends to expand and contract in the plan direction. Therefore, the accuracy of the distance between the mounting hole and the tip end part of the wiping member is sometimes deteriorated, and the flatness of the tip end part might not be secured. Moreover, in order to solve such disadvantages, a method is proposed in which a mounting hole and the tip end of a wiping member is punched out before the other portions are formed when the wiping member is punched out (see JP-A-2001-10072 (Patent Reference 2)), which greatly restricts the fabrication process steps.

Furthermore, in the blade before, a number of slits are processed on the tip end of the wiping member which rubs over the ink discharge area, and the cleaning effect is improved by scraping off ink residues and foreign substances near irregular portions formed in the ink discharge area or by absorbing ink liquid into the slits with capillary attraction. These slits are formed when the wiping member is punched out.

However, as the slit width becomes narrower, more machining accuracy is demanded, and it is difficult to form the slits by punching out for the slit width in μm order. Furthermore, when the slit in narrow width is formed only by cutting the tip end part of the wiping member with a cutter, the cut areas of the adjacent wiping members are closely contacted with each other, or the pieces of the wiping members separated by the slits are overlapped with each other in places when the wiping member rubs the ink discharge area, causing places not wiped or no capillary attraction working. Moreover, the wiping member is mounted on the supporting plate to contract the wiping member because of the difference in the linear expansion coefficients thereof, and thus it is difficult to maintain the dimensional accuracy of the length and width of the slit in punching out.

SUMMARY OF THE INVENTION

Accordingly, it is desirable to provide a long cleaning blade for a liquid discharge head, in which the flatness and the stiffness of its tip end part can be secured in the entire length, the mounting accuracy can be attained easily, and slits in narrow width can be formed easily, a method of fabricating a cleaning blade, and a cleaning apparatus for a liquid discharge head.

A cleaning blade according to an embodiment of the invention is a cleaning blade which wipes a liquid discharge area by being moved relatively with respect to the liquid discharge area of a liquid discharge head having the liquid discharge area in which liquid discharge nozzles are arranged to discharge a liquid, the cleaning blade including: a supporting plate which has an adhesive agent layer on its front surface; and a wipe part which is slid and contacted with the liquid discharge area, the wipe part formed in which an elastic part formed of a synthetic resin is formed in one piece on the adhesive agent layer, and a tip end thereof is cut in a predetermined shape.

Furthermore, a method of fabricating a cleaning blade according to an embodiment of the invention is a method of fabricating a cleaning blade having a wipe part which is slid and contacted with a liquid discharge area of a liquid discharge head and a supporting plate which supports a base end part of the wipe part, the cleaning blade cleaning the liquid discharge area, the method including the steps of: forming an elastic part slightly greater than a predetermined length and/or width of the wipe part and the supporting plate in one piece; and cutting the tip end of the elastic part in a predetermined shape to form the wipe part.

Furthermore, a method of fabricating a cleaning blade according to an embodiment of the invention is a method of fabricating a cleaning blade having a wipe part which is slid and contacted with a liquid discharge area of a liquid discharge head and a supporting plate which supports a base end part of the wipe part, the cleaning blade cleaning the liquid discharge area, the method including the steps of: forming the supporting plate and the wipe part in one piece; and forming cuts in a tip end part of the wipe part at predetermined intervals to form slits.

Furthermore, a cleaning apparatus for a liquid discharge head according to an embodiment of the invention is a cleaning apparatus for a liquid discharge head of a liquid discharge apparatus including: a liquid discharge head having a liquid discharge area in which liquid discharge nozzles are arranged to discharge a liquid; a cleaning blade which is slid and contacted with the liquid discharge area to wipe the liquid discharge area; a moving mechanism which moves the cleaning blade with respect to the liquid discharge head; and a switching member which retracts the cleaning blade from a position at which the cleaning blade is slid and contacted with the liquid discharge area when the cleaning blade is moved to one side by the moving mechanism with respect to the liquid discharge head, and which returns the cleaning blade to a position at which the cleaning blade is slid and contacted with the liquid discharge area when the cleaning blade is moved to the other side by the moving mechanism with respect to the liquid discharge head, wherein the cleaning blade includes: a supporting plate which has an adhesive agent layer on its front surface; and a wipe part which is slid and contacted with the liquid discharge area, the wipe part formed in which an elastic part formed of a synthetic resin is formed in one piece on the adhesive agent layer, and a tip end thereof is cut in a predetermined shape.

According to the cleaning blade, the method of fabricating the same, and the cleaning apparatus for a liquid discharge head according to an embodiment of the invention, since the supporting plate and the wipe part are formed in one piece, the cleaning blade has the stiffness in the entire length. Furthermore, the supporting plate and the elastic part configuring the wipe part are formed in one piece, and then the piece is cut in accordance with the shape of the wipe part. Therefore, the flatness of the tip end part of the wipe part can be secured highly accurately in the entire length. Since the wipe part is formed by cutting the elastic part after punched out, two corner parts of the wipe part in the sectional form can be formed square.

Therefore, since the flatness and the stiffness are provided highly accurately in the entire length of the wipe part, foreign substances attached to the liquid discharge area can be surely wiped off in the overall width of the liquid discharge area. Furthermore, since two corner parts of the wipe part in the sectional form have square edges, the performance of removing ink and waste is improved.

Moreover, in the method of fabricating a cleaning blade according to an embodiment of the invention, the supporting plate is formed in one piece with the wipe part, and then cuts are formed in the wipe part. More specifically, cuts are formed in the state in which internal stress works in the wipe part in the longitudinal direction due to the difference in the linear expansion coefficients between the supporting plate and the wipe part. Thus, stresses to contract inward work in each of the cut areas. Therefore, the slits in narrow width can be formed uniformly in the wipe part in the longitudinal direction. Furthermore, according to the cleaning blade with these slits and the cleaning apparatus for a liquid discharge head, in each of the wipe pieces separated by the slits, the cut areas are not closely contacted with each other, or the wipe pieces are not overlapped with each other due to stress, or the cleaning performance is not deteriorated.

DETAILED DESCRIPTION OF THE INVENTION

Hereinafter, a cleaning blade, a method of fabricating a cleaning blade, and a cleaning apparatus for a liquid discharge head according to an embodiment of the invention will be described in detail with reference to the drawings. The cleaning blade according to an embodiment of the invention is used for an ink discharge apparatus, a so-called ink jet printing apparatus (hereinafter, denoted as a printing apparatus) which discharges ink onto a paper sheet to be a target object and prints images and characters thereon. In addition, an ink jet printing apparatus 1 here is a so-called line scan head printing apparatus in which ink discharge nozzles are arranged as matched with the print span of a paper sheet.

Figure 1:
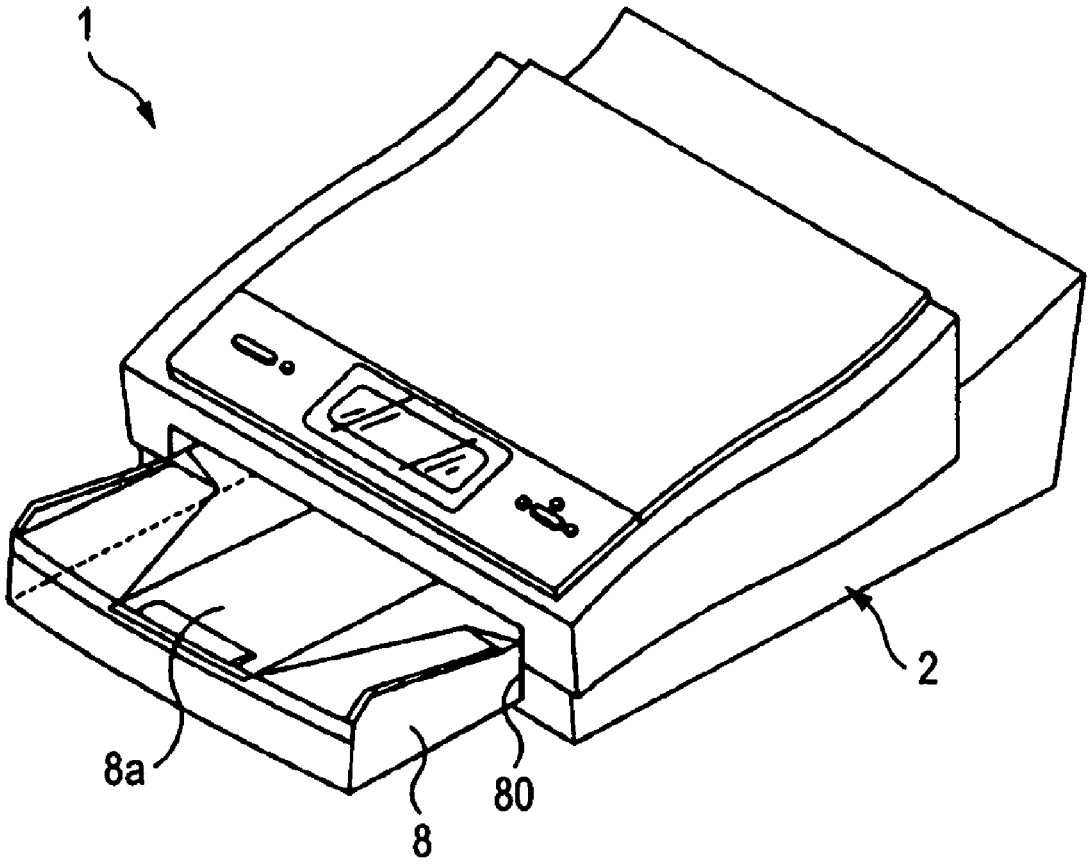
FIG. 1 shows a perspective view depicting the appearance of a printing apparatus to which an embodiment of the invention is adapted.
Figure 2:
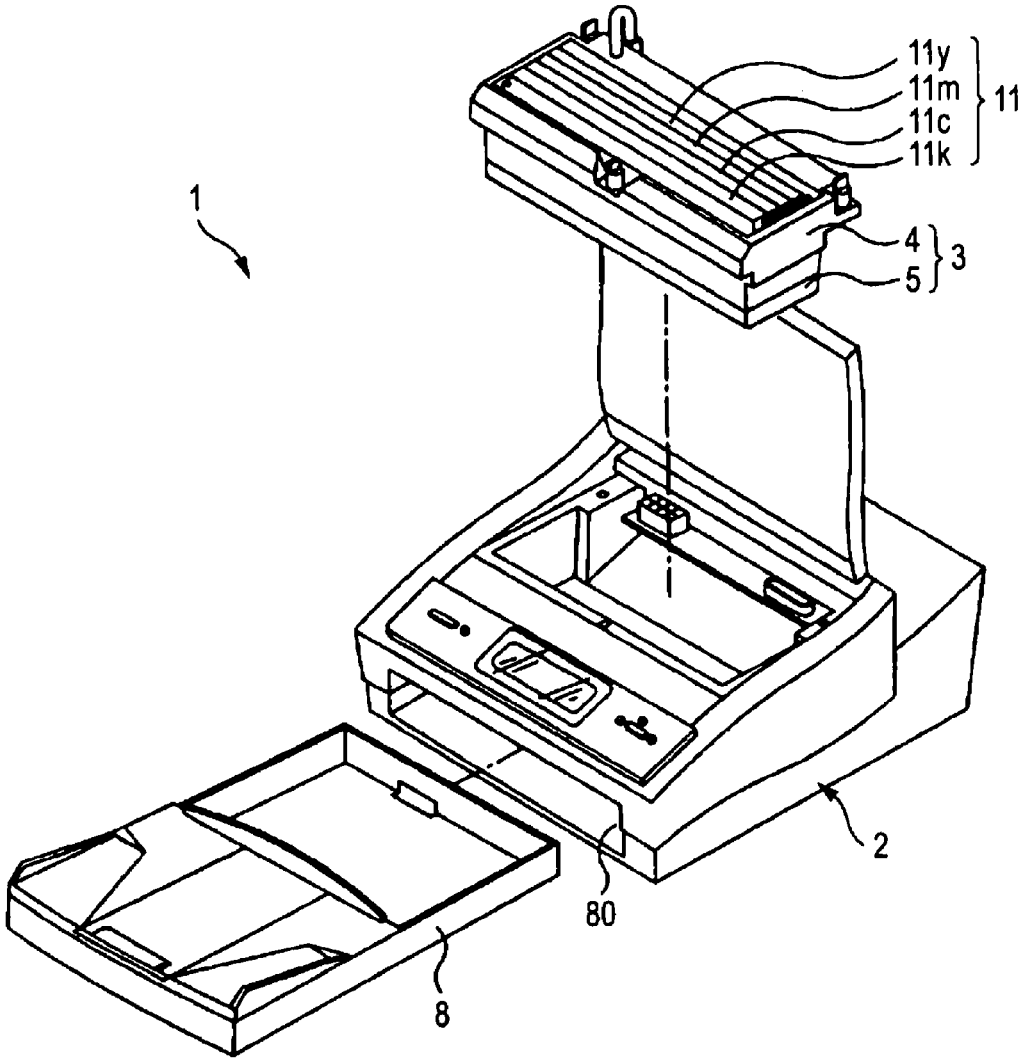
FIG. 2 shows a perspective view depicting the appearance of the printing apparatus on which an ink discharge head and a paper tray are mounted.

As shown in FIGS. 1 and 2, the printing apparatus 1 has a printer main body 2. The printer main body 2 has an ink discharge head 3 including a head cartridge 4 which is mounted with ink cartridges to discharge ink and a headcap 5 which protects the head cartridge 4, a cap moving mechanism 6 which moves the headcap 5 in the open/close direction of the head cartridge 4, a control mechanism 7 (see FIG. 28) which controls the printing apparatus 1, and a paper tray 8 which accommodates paper sheets.

In the printing apparatus 1, the ink discharge head 3 is detachable from the printer main body 2, and ink cartridges 11*y*, 11*m*, 11*c*, and 11*k* to be ink supply sources are detachable from the head cartridge 4. In addition, in the printing apparatus 1, the yellow ink cartridge 11*y*, the magenta ink cartridge 11*m*, the cyan ink cartridge 11*c*, and the black ink cartridge 11*k* can be used. Furthermore, the ink discharge head 3 detachable from the printer main body 2 and the ink cartridges 11*y*, 11*m*, 11*c*, and 11*k* detachable from the head cartridge 4 are consumable items and exchangeable.

In the printing apparatus 1 like this, a paper tray 8 in which paper sheets are layered and accommodate therein is mounted on a tray insertion port 80 disposed on the front bottom side of the printer main body 2, whereby the paper sheets P accommodated in the paper tray 8 can be fed into the printer main body 2. When the paper tray 8 is mounted on the tray insertion port 80 in the front side of the printer main body 2, a paper sheet P is pressed against a paper feed roller 81 by a paper feed and eject mechanism 9 inside the apparatus, and the paper feed roller 81 is rotated to feed the paper sheet out of the tray insertion port 80 to the back side of the printer main body 2 in an arrow A direction shown in FIG. 4.

Then, in the printing apparatus 1, the transfer direction of the paper sheet P transferred to the back side of the printer main body 2 is reversed by a reverse roller 83, and the paper sheet P is transferred from the back side of the printer main body 2 to the front side. On the paper sheet P transferred from the back side of the printer main body 2 to the front side, characters and images are printed by the head cartridge 4 in accordance with character data and image data inputted by an information processing unit such as a personal computer until the paper sheet P is ejected out of the tray insertion port 80 disposed on the front side of the printer main body 2.

Figure 3:
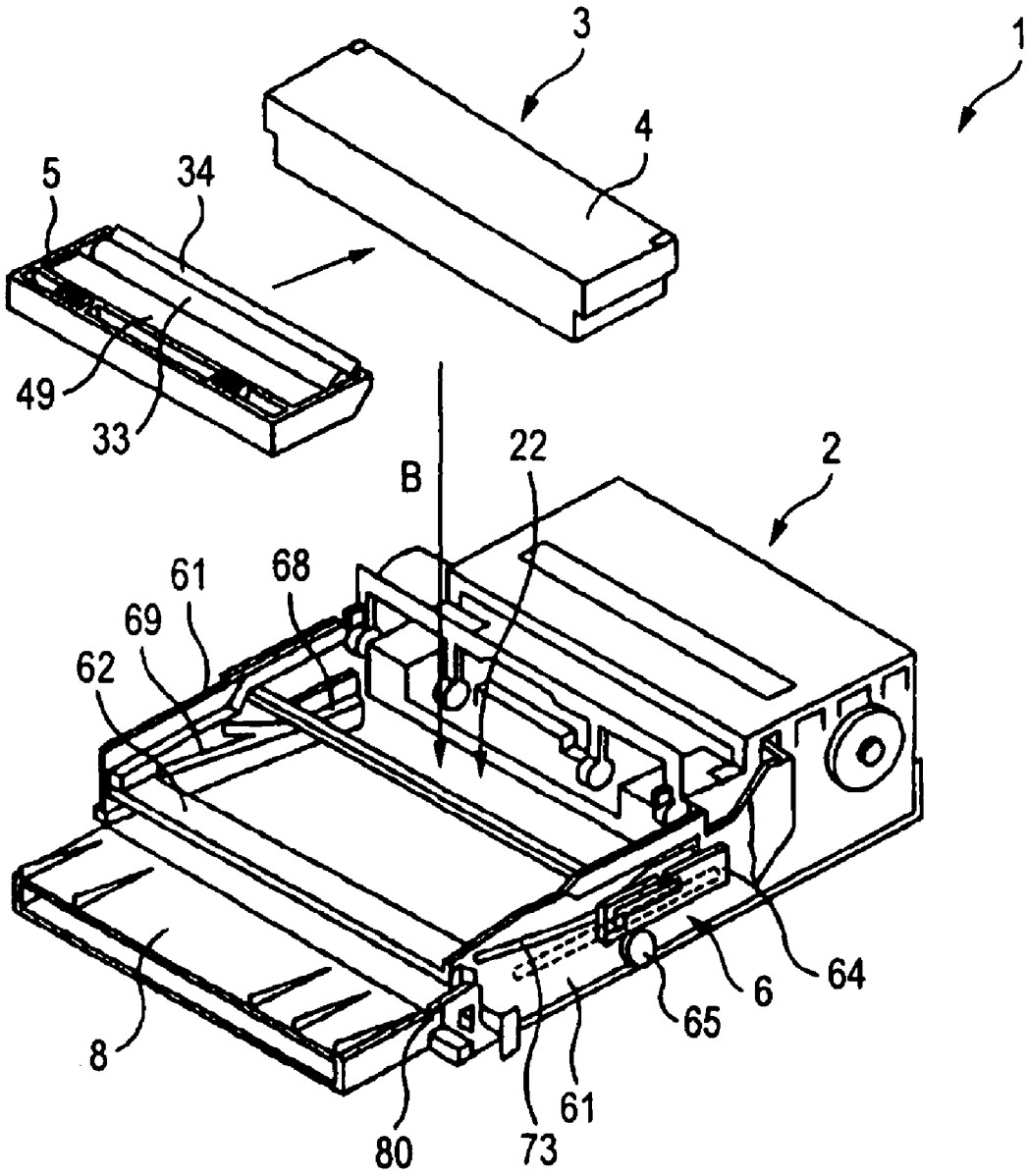
FIG. 3 shows an exploded perspective view depicting the printing apparatus.

As indicated by an arrow B in FIG. 3, the head cartridge 4 which prints the paper sheet P is mounted on a cartridge mounting part 22 from the top side of the printer main body 2, and discharges an ink i onto the paper sheet P running on the returning path for printing. More specifically, the head cartridge 4 makes the ink i in liquid into fine particles by electrothermal conversion or electromagnetic conversion, for example, discharges the particles, and sprays ink drops onto a recording medium such as the paper sheet P for printing.

Figure 5:
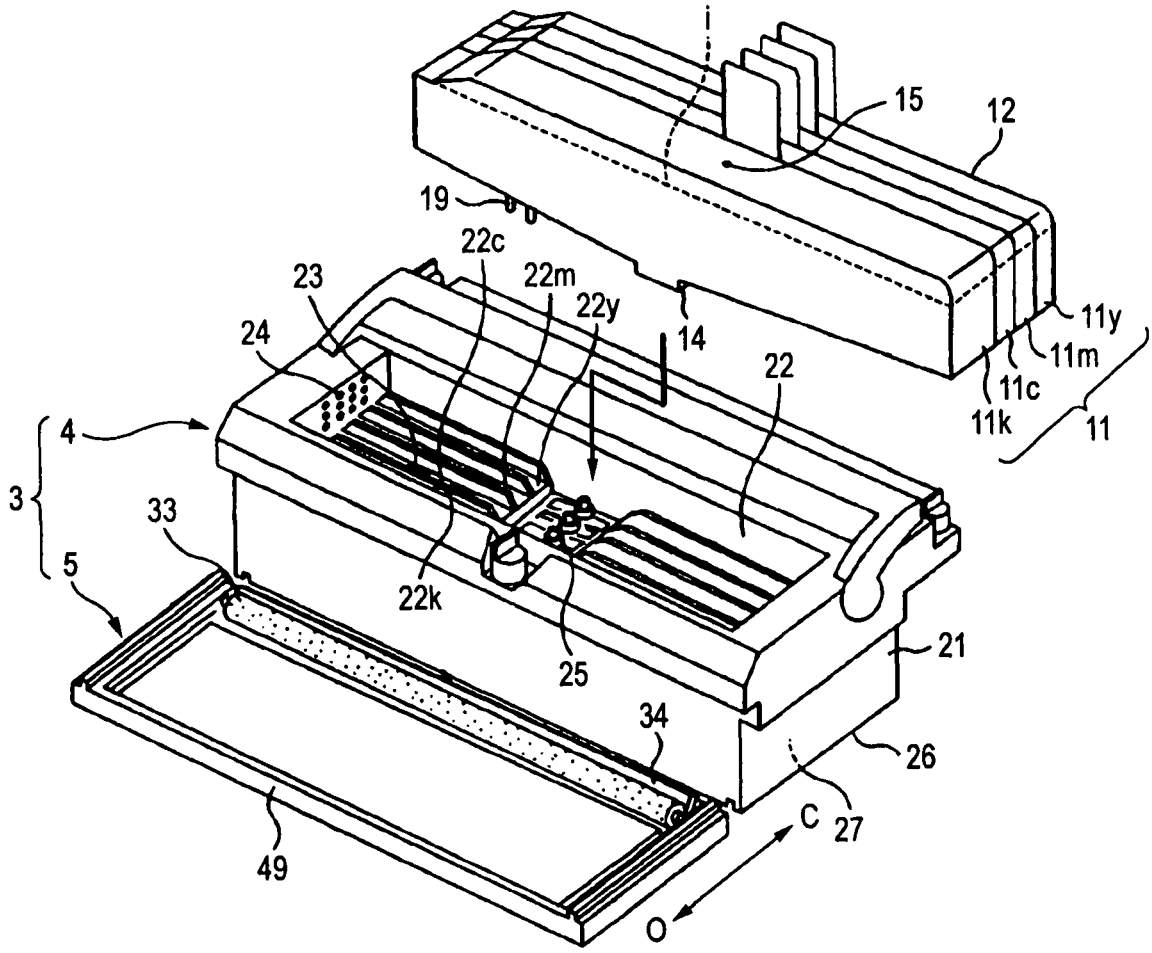
FIG. 5 shows a perspective view depicting the ink discharge head.
Figure 6:
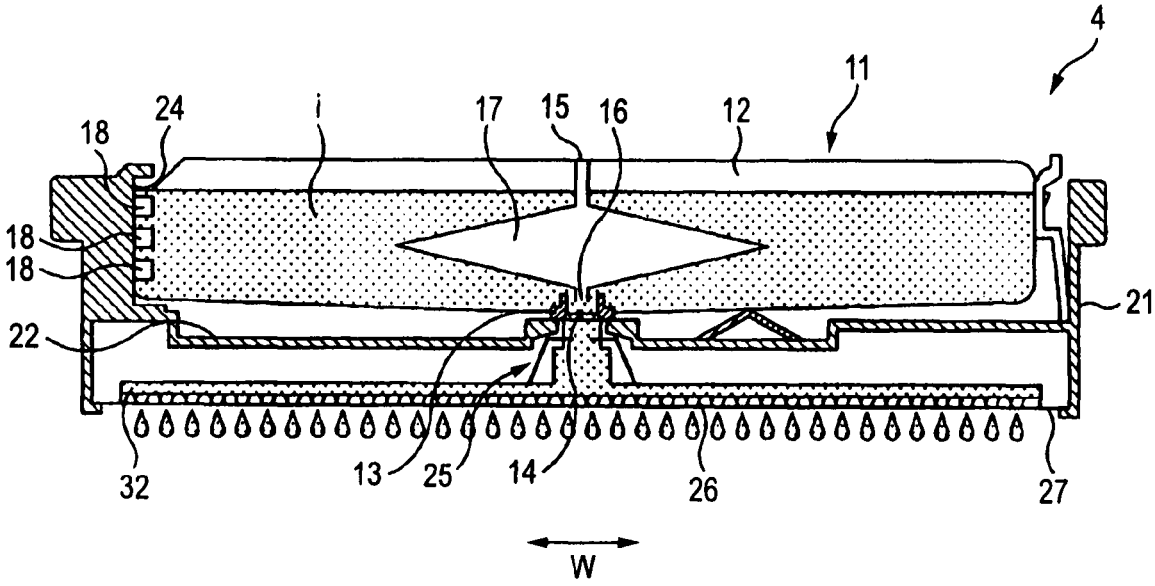
FIG. 6 shows a cross section depicting a head cartridge to which an ink cartridge is mounted.

As shown in FIGS. 5 and 6, the ink cartridge 11 which supplies ink to the head cartridge 4 has a cartridge tank 12 detachably formed in the head cartridge 4. The cartridge tank 12 is formed in a nearly rectangular shape that is almost the same size as the size in the width direction of the paper sheet P that is used lengthwise, and it is configured to increase the ink capacity of ink stored inside at the maximum.

More specifically, the cartridge tank 12 configuring the ink cartridge 11 has an ink accommodating part 13 which accommodates the ink i, an ink supply part 14 which supplies the ink i from the ink accommodating part 13 to a cartridge main body 21 of the head cartridge 4, an external communicating hole 15 which takes outside air into the ink accommodating part 13, an air inlet 16 which leads air taken through the external communicating hole 15 into the ink accommodating part 13, an ink reservoir 17 which temporarily stores the ink i between the external communicating hole 15 and the air inlet 16, a remaining quantity detecting part 18 which detects the remaining quantity of the ink i inside the ink accommodating part 13, and a projected engaging part 19 which engages in the cartridge mounting part 22 disposed on the cartridge main body 21 of the head cartridge 4.

The ink supply part 14 is disposed near the center part under the ink accommodating part 13, which is a connecting part to the head cartridge 4. The ink supply part 14 is a nozzle in a nearly projected shape communicating with the ink accommodating part 13, and the tip end of the nozzle is fit into a connecting part 25 of the head cartridge 4, described later, whereby the cartridge tank 12 of the ink cartridge 11 is connected to the cartridge main body 21 of the head cartridge 4, allowing the ink i to be supplied to the head cartridge 4.

As shown in FIG. 6, the external communicating hole 15 is a vent which takes air into the ink accommodating part 13 from outside the ink cartridge 11, which is disposed on the top side of the cartridge tank 12, here, near the center part of the top side, the position is located to face outside when mounted on the cartridge mounting part 22, in order to expose itself outside and to take into outside air even when mounted on the cartridge mounting part 22 of the head cartridge 4. The external communicating hole 15 takes air into the ink cartridge 11 from outside by the amount matched with the amount of the ink i reduced inside the ink accommodating part 13 when the ink cartridge 11 is mounted on the cartridge main body 21 and the ink i flows down from the ink accommodating part 13 to the cartridge main body 21.

The air inlet 16 communicates the ink accommodating part 13 with the external communicating hole 15, and leads the air taken by the external communicating hole 15 into the ink accommodating part 13. Therefore, even though the ink i is supplied to the cartridge main body 21 and the ink i inside the ink accommodating part 13 is reduced to turn the inside of the cartridge tank 12 to the decompressed state when the ink cartridge 11 is mounted on the cartridge main body 21, the internal pressure is retained in the equilibrium state to properly supply the ink i to the cartridge main body 21 because air is taken into the ink accommodating part 13 through the air inlet 16.

The ink reservoir 17 is disposed between the external communicating hole 15 and the air inlet 16, which temporarily stores the ink i so as not to cause a sudden flow of ink to outside when the ink i leaks out of the air inlet 16 communicating with the ink accommodating part 13. More specifically, in the ink cartridge 11, the ink reservoir 17 has no ink i at room temperature and normal pressure. However, in the ink cartridge 11, when external pressure drops or external temperature rises, the air inside the ink accommodating part 13 is expanded, and the expanded air pushes the ink i out of the ink accommodating part 13 to the ink reservoir 17 through the air inlet 16. At this time, since the ink reservoir 17 temporarily stores the ink i pushed out of the ink accommodating part 13, the ink i can be prevented from leaking out of the external communicating hole 15. The ink reservoir 17 is formed nearly in a rhombus that a long diagonal line is in the longitudinal direction of the ink accommodating part 13, in which the air inlet 16 is disposed at the corner positioned at the lowermost side of the ink accommodating part 13, that is, at the under side of a short diagonal line, and the ink coming from the ink accommodating part 13 can be again returned to the ink accommodating part 13. Furthermore, in the ink reservoir 17, the external communicating hole 15 is disposed at the corner on the uppermost side of a short diagonal line, and the ink coming from the ink accommodating part 13 is hard to leak out of the external communicating hole 15.

As shown in FIG. 6, the remaining quantity detecting part 18 is disposed on one side in the longitudinal direction of the cartridge tank 12. The remaining quantity detecting part 18 has a pair of detection pins which face the inside of the ink accommodating part 13, and a contact member which includes a contact electrically contacted to the ink remaining quantity detecting part 24 of the head cartridge 4 when the ink cartridge 11 is mounted on the cartridge mounting part 22 of the head cartridge 4. The contact member is arranged side by side in multiple numbers in the height direction of the side surface of the cartridge tank 12. An ink with conductivity is used for the ink i, which reduces the electric resistance value of the detection pins when the ink immerses a pair of the detection pins facing the inside of the ink accommodating part 13, whereas which increases the electric resistance value of the detection pins when the ink does not immerse the pins therein. More specifically, when the ink i is filled in the ink accommodating part 13, all the detection pins are immersed in the ink, and all the electric resistance values are low. Then, as the ink is used, the electric resistance values of the detection pins in turn become greater from the upper stage. Therefore, the remaining quantity detecting part 18 can detect the ink remaining quality inside the ink accommodating part 13.

In addition, in the ink cartridge 11, since the amount of consumption of black ink is generally greatest in printing, it is considered that the capacity of the ink accommodating part 13 of the ink cartridge 11*k* is greater than the other ink cartridges 11*y*, 11*m*, and 11*c*. More specifically, only the ink cartridge 11*k* is formed thicker than the other ink cartridges 11*y*, 11*m*, and 11*c*.

Next, the configuration of the head cartridge 4 on which the ink cartridge 11 is mounted will be described. As shown in FIGS. 5 and 6, the head cartridge 4 has the cartridge main body 21. The cartridge main body 21 has the cartridge mounting part 22 on which the ink cartridge 11 is mounted, a recessed engaging part 23 in which the projected engaging part 19 is engaged, the ink remaining quantity detecting part 24 which detects the ink remaining quality inside the ink cartridge 11, the connecting part 25 to which the ink supply part 14 is connected and the ink i is supplied, and ink discharge nozzles 26 which discharge ink, in which the bottom to which the ink discharge nozzles 26 face is an ink discharge area 27.

The cartridge mounting part 22 on which the ink cartridge 11 is mounted is formed nearly in a recessed shape so as to mount the ink cartridge 11 thereon as the top side is the port for attaching and detaching the ink cartridge 11. Here, cartridge mounting parts 22*y*, 22*m*, 22*c*, and 22*k* to which the ink cartridges 11*y*, 11*m*, 11*c*, and 11*k* for individual colors are attached and detached are housed side by side in the running direction of paper sheets.

The recessed engaging part 23 is disposed on each of the cartridge mounting parts 22*y*, 22*m*, 22*c*, and 22*k*, which correspondingly engages in the projected engaging part 19 which is disposed in a different pattern for each of the ink cartridges 11*y*, 11*m*, 11*c*, and 11*k*.

The ink remaining quantity detecting part 24 detects the remaining quantity of the ink i in the ink cartridge 11 step by step, which is disposed on the cartridge mounting parts 22*y*, 22*m*, 22*c*, and 22*k* of the color ink cartridges 11*y*, 11*m*, 11*c*, and 11*k*. When the ink cartridge 11 is mounted on the head cartridge 4, the ink remaining quantity detecting part 24 is contacted and electrically connected to the remaining quantity detecting part 18 arranged side by side in the side surface in the height direction inside the ink cartridge 11.

Near the center in the longitudinal direction of the cartridge mounting part 22, the connecting part 25 is disposed to which the ink supply part 14 is connected when the ink cartridge 11 is mounted on the cartridge mounting part 22. The connecting part 25 is an ink supply path which supplies ink from the ink supply part 14 of the ink cartridge 11 mounted on the cartridge mounting part 22 to the ink discharge nozzles 26 that are disposed on the bottom of the cartridge main body 21 to discharge ink. The connecting part 25 has a valve mechanism, detail is omitted, and controls supply from the cartridge tank 12 to the ink discharge nozzles 26.

Figure 7:
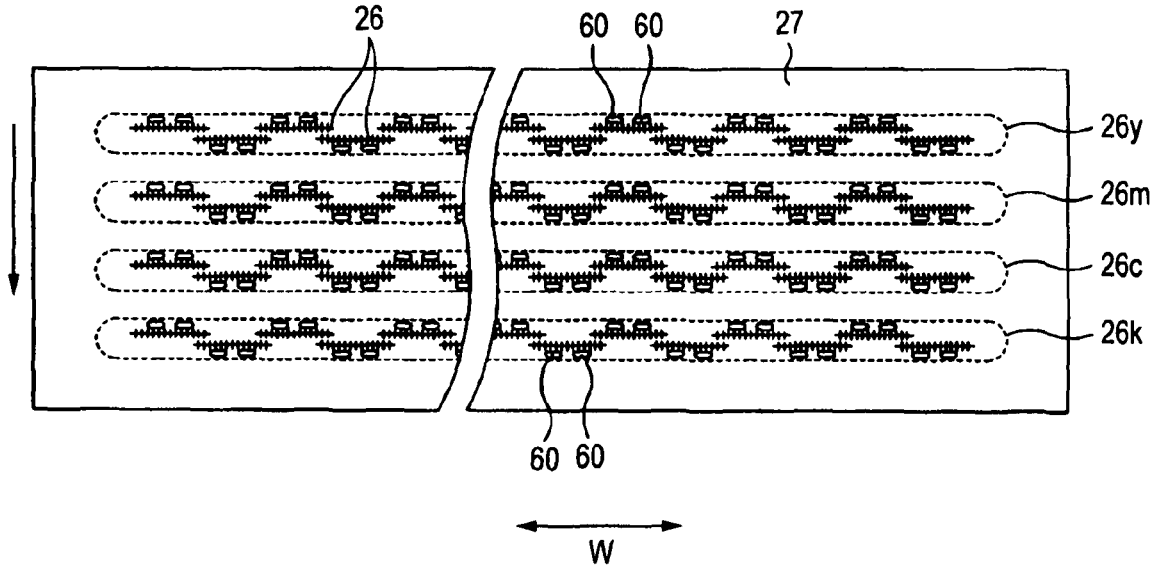
FIG. 7 shows a plan view depicting an ink discharge area of the head cartridge.

The ink discharge nozzles 26 to which the ink i is supplied from the connecting part 25 are arranged in the longitudinal direction of the ink discharge area 27 that is the bottom of the cartridge main body 21. More specifically, as shown in FIGS. 6 and 7, the ink discharge nozzles 26 are arranged nearly in a line in each color in an arrow W direction in FIGS. 6 and 7 that is the width direction of the paper sheet P in the ink discharge area 27 which is the bottom of the cartridge main body 21. In the ink discharge nozzles 26, nozzle lines 26*y*, 26*m*, 26*c*, and 26*k* for individual colors are arranged along the alignment of the ink cartridge 11 of each color on the cartridge main body 21 from the back side of the printer main body 2 to the front side. The nozzle lines 26*y*, 26*m*, 26*c*, and 26*k* are formed in almost the same length as the width of the paper sheet P, which discharge the ink i for each of yellow, magenta, cyan, and black nozzle lines without moving in the width direction of the paper sheet P when the paper sheet P is printed.

Figure 8A:
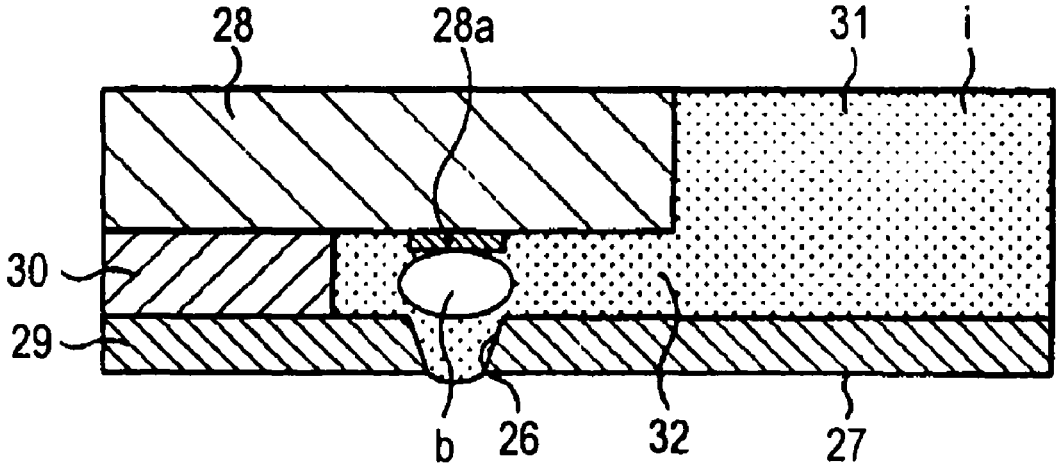
FIGS. 8A and 8B show cross sections depicting the ink discharge nozzle of the head cartridge.
Figure 8B:
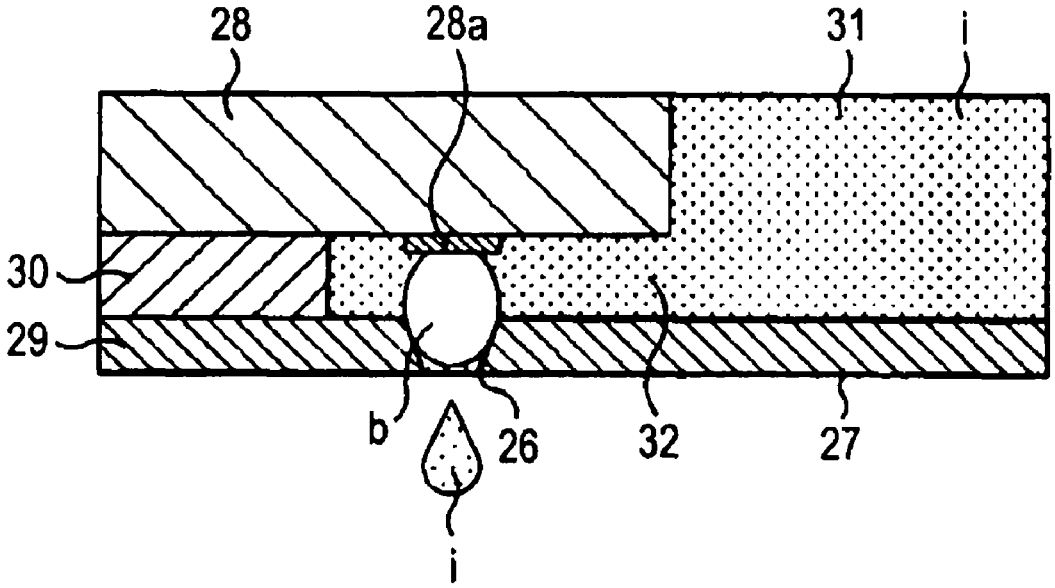

As shown in FIGS. 8A and 8B, on the bottom part of the cartridge main body 21, an ink passage 31 is formed which feeds the ink i supplied from the connecting part 25 to each of the ink discharge nozzles 26. The ink passage 31 is formed of a circuit board 28 on which an electrothermal conversion heat element 28*a* is disposed, a nozzle sheet 29 in which the ink discharge nozzles 26 are formed, and a film 30 which is disposed between the circuit board 28 and the nozzle sheet 29. The ink passage 31 is formed long in the direction in which the ink discharge nozzles 26 are arranged side by side, that is, in the arrow W direction in FIG. 6. Therefore, in the ink discharge nozzles 26, the ink i flows into the ink passage 31 from each of the ink cartridges 11*y*, 11*m*, 11*c*, and 11*k* through the connecting part 25 of the cartridge main body 21, and the ink i is supplied from the ink passage 31.

Furthermore, for the ink discharge nozzles 26, an ink liquid chamber 32 is formed which is surrounded by the circuit board 28, the nozzle sheet 29, and the film 30, in which the heat element 28*a* pressurizes ink. The ink liquid chamber 32 is connected to the ink passage 31, to which the ink i is supplied from the ink passage 31.

In the ink discharge nozzles 26 thus configured, pulse current is fed to the heat element 28*a* selected based on a control signal at a drive frequency of 9 kHz, for example. Therefore, the ink discharge nozzle 26 quickly heats the heat element 28*a*. When the ink discharge nozzle 26 heats the heat element 28*a*, a bubble b is generated in the ink i contacted with the heat element 28*a*, as shown in FIG. 8A. Then, as shown in FIG. 8B, the bubble b is expanding to pressurize the ink i, and the ink discharge nozzle 26 discharges the pressurized ink i in a liquid drop. Furthermore, the ink discharge nozzle 26 discharges the ink i in a liquid drop, and it supplies the ink i to the ink liquid chamber 32 through the ink passage 31, whereby it returns to the state before discharge. The ink discharge nozzle 26 repeats the operation described above based on the control signal.

Figure 9:
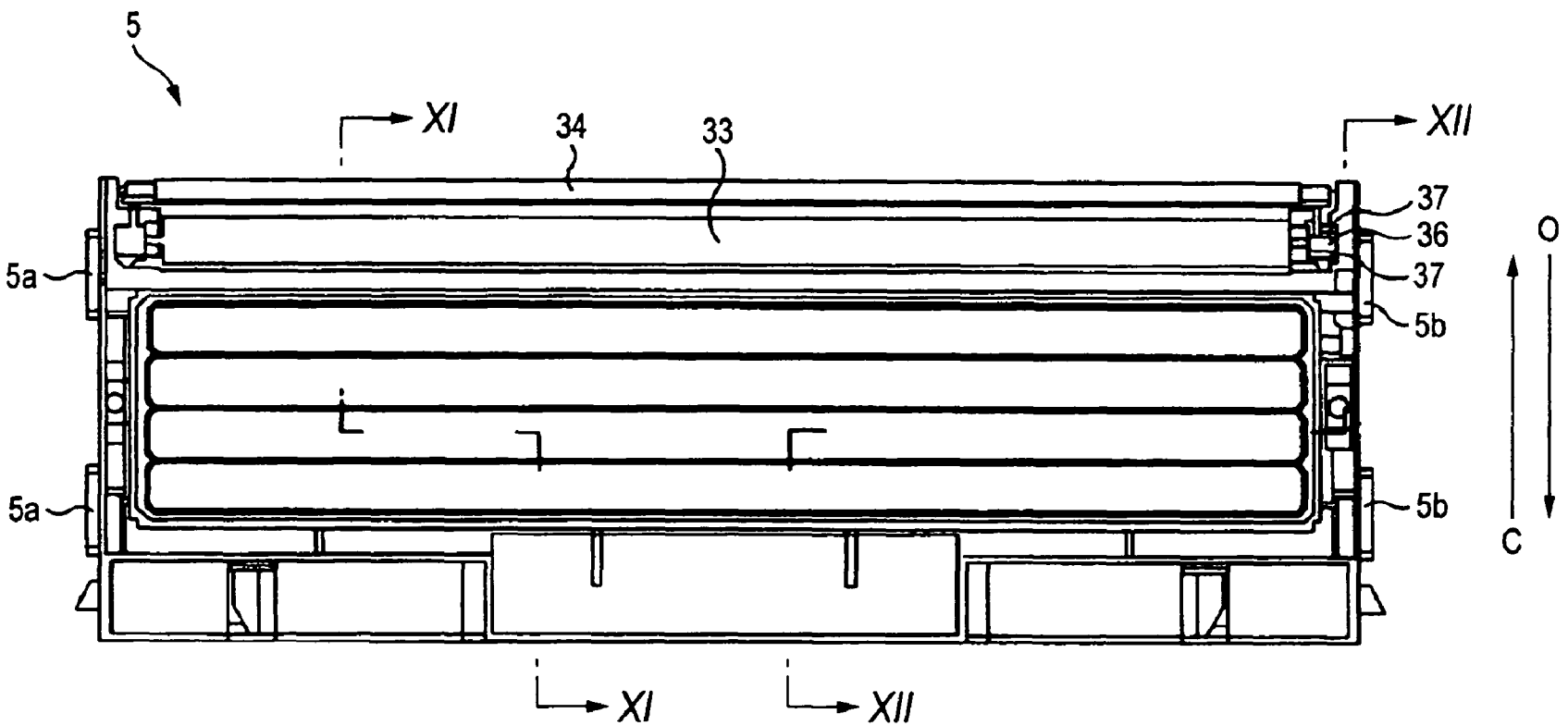
FIG. 9 shows a plan view depicting a headcap.
Figure 10:
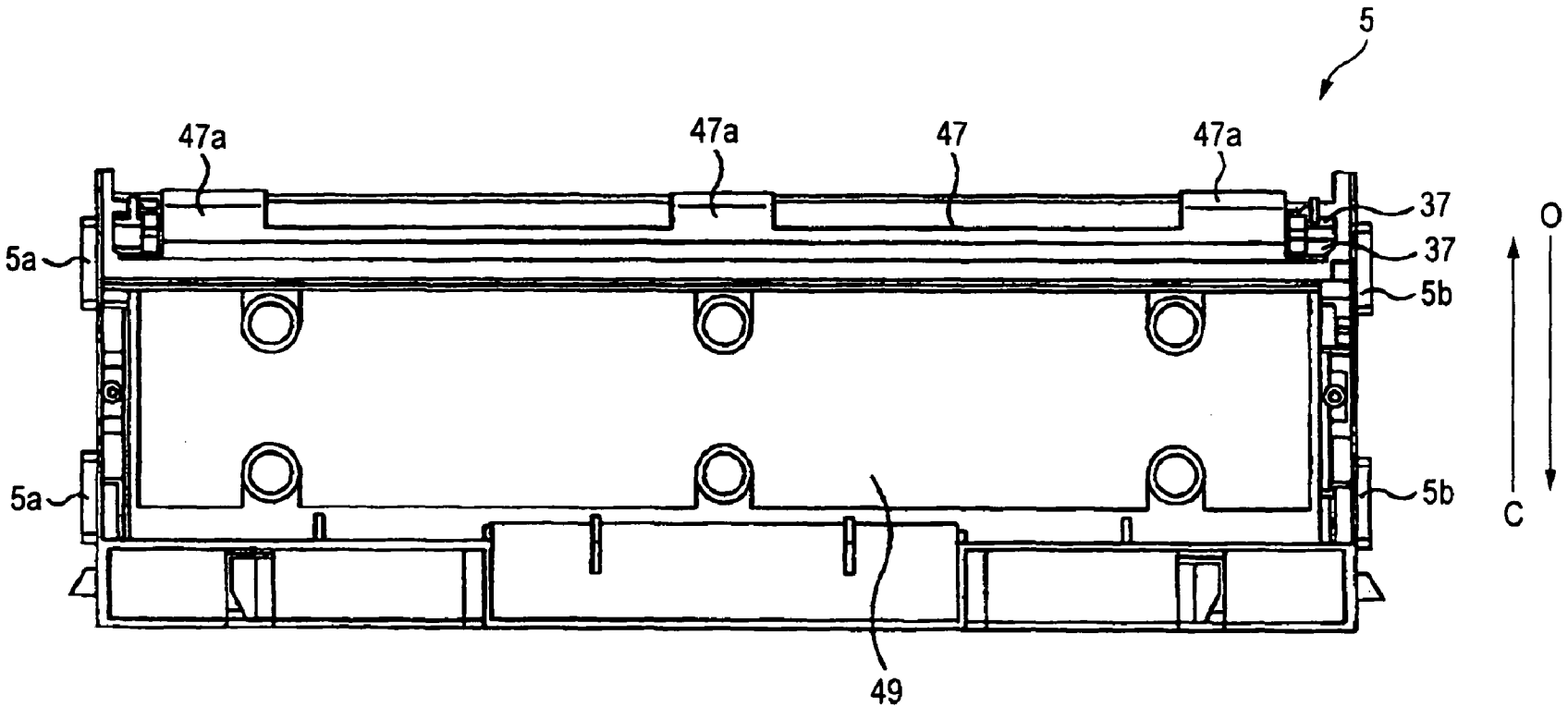
FIG. 10 shows a plan view depicting the inside of the headcap.
Figure 11:
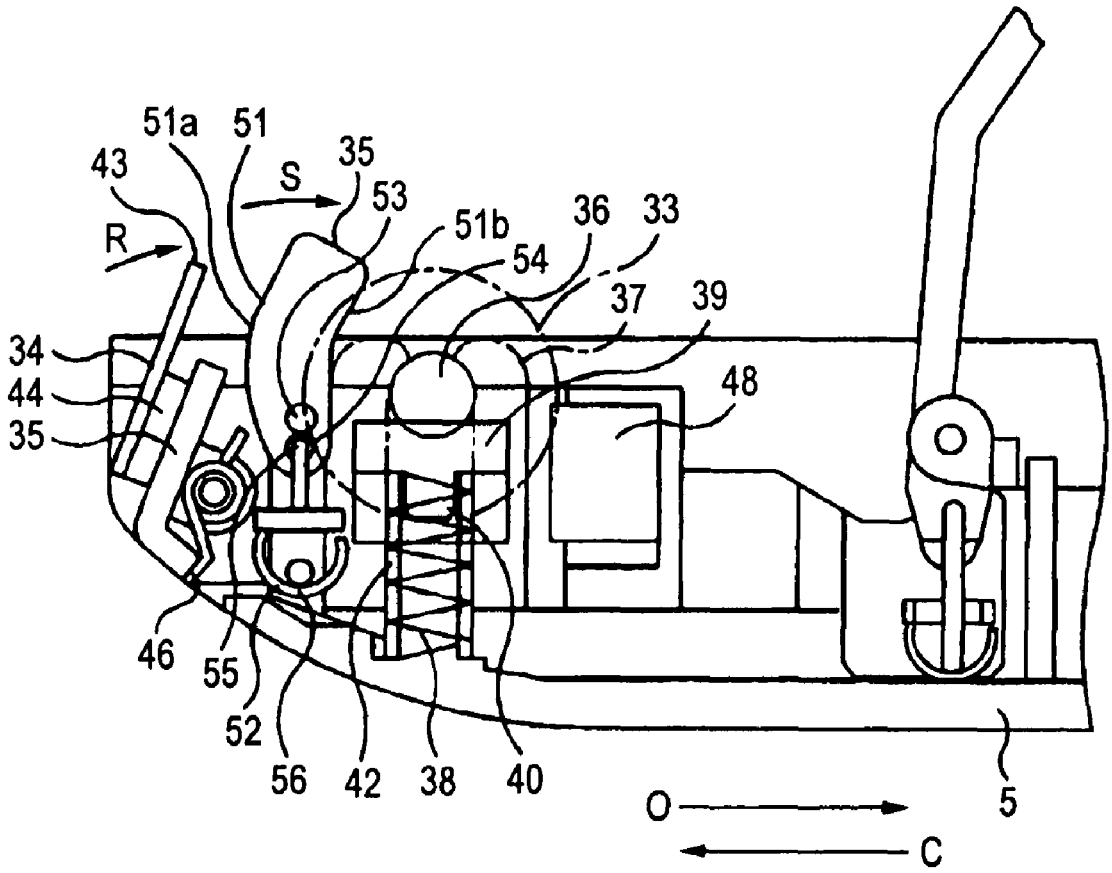
FIG. 11 shows an x-x cross section depicting the headcap shown in FIG. 9.
Figure 12:
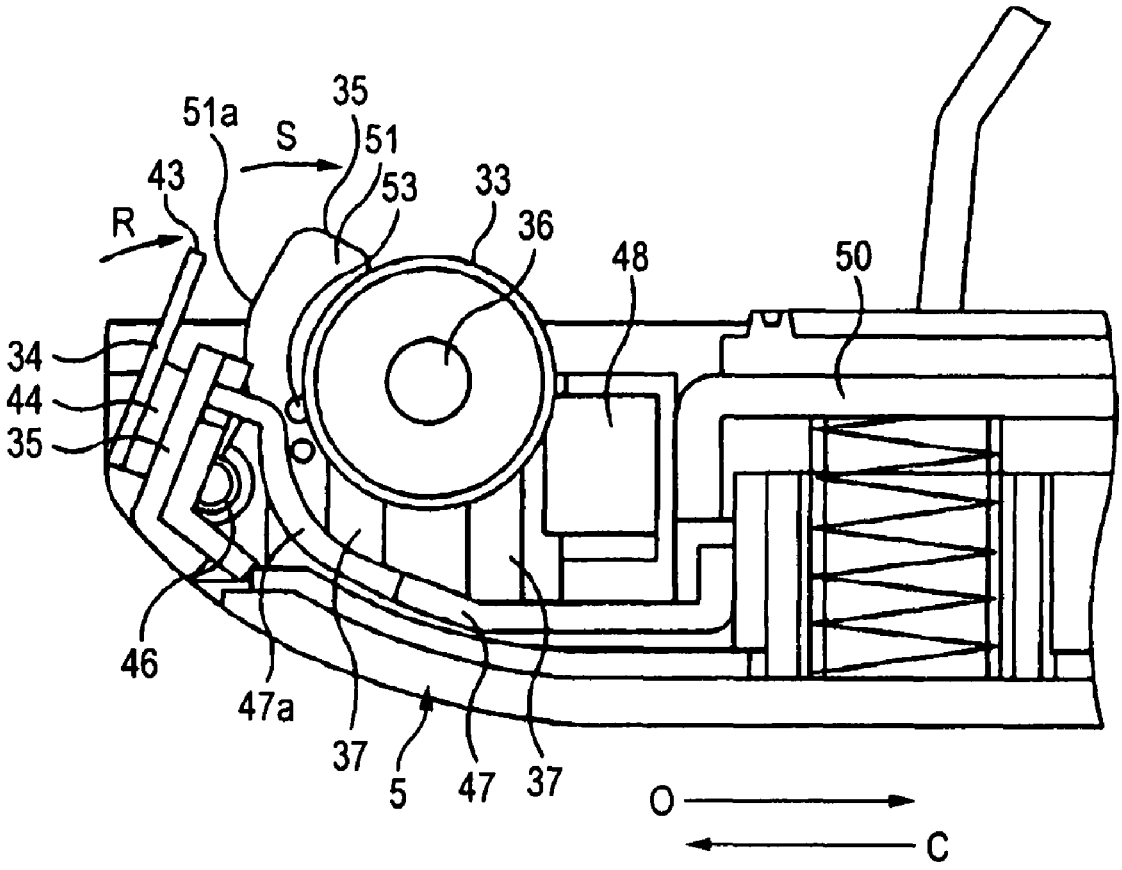
FIG. 12 shows a y-y cross section depicting the headcap shown in FIG. 9.
Figure 13:
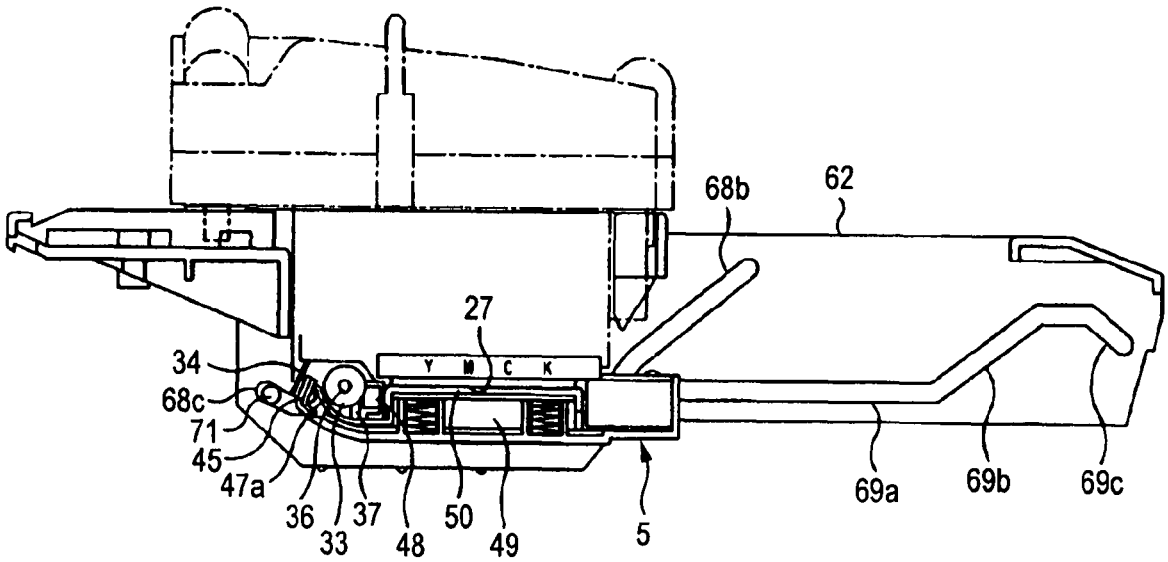
FIG. 13 shows a side view depicting the ink discharge head in the state in which the headcap blocks the head cartridge.
Figure 14:
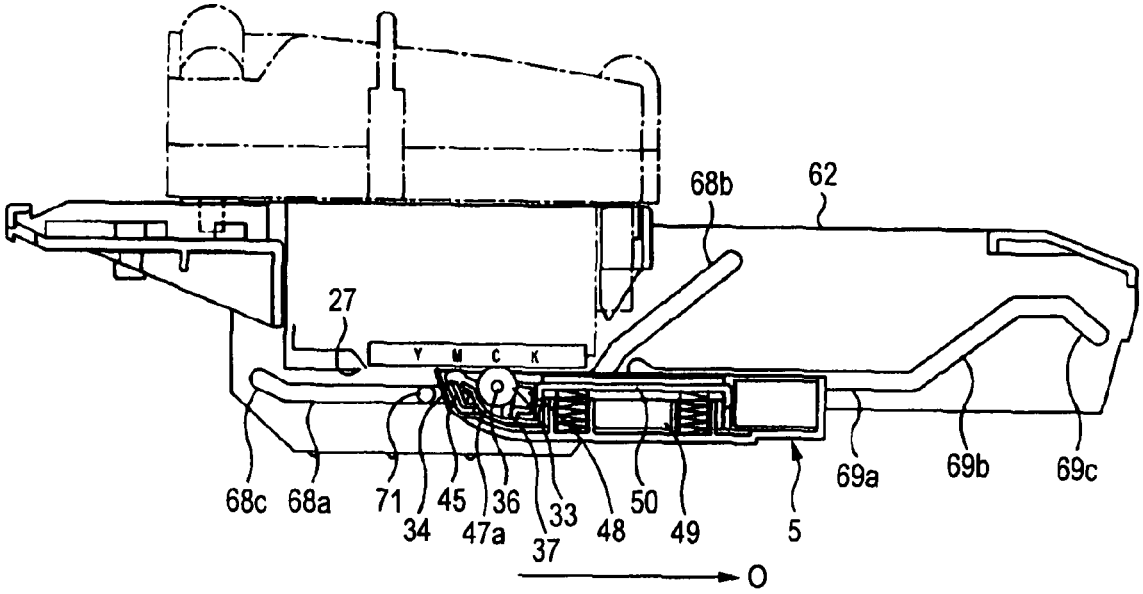
FIG. 14 shows a side view depicting the ink discharge head in the state in which the headcap opens the head cartridge.
Figure 15:
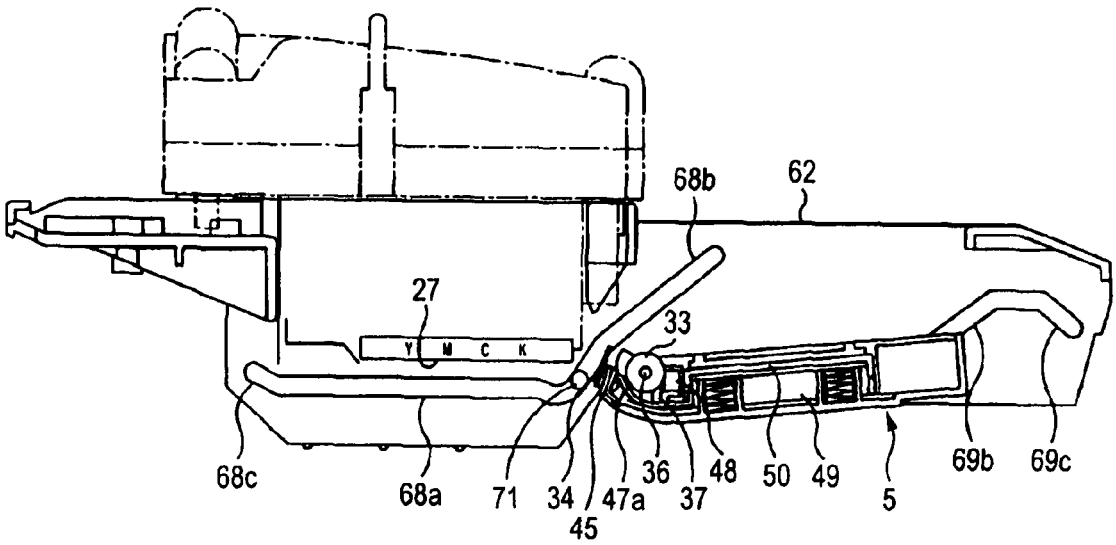
FIG. 15 shows a side view depicting the ink discharge head in the state in which the headcap opens the head cartridge.
Figure 16:
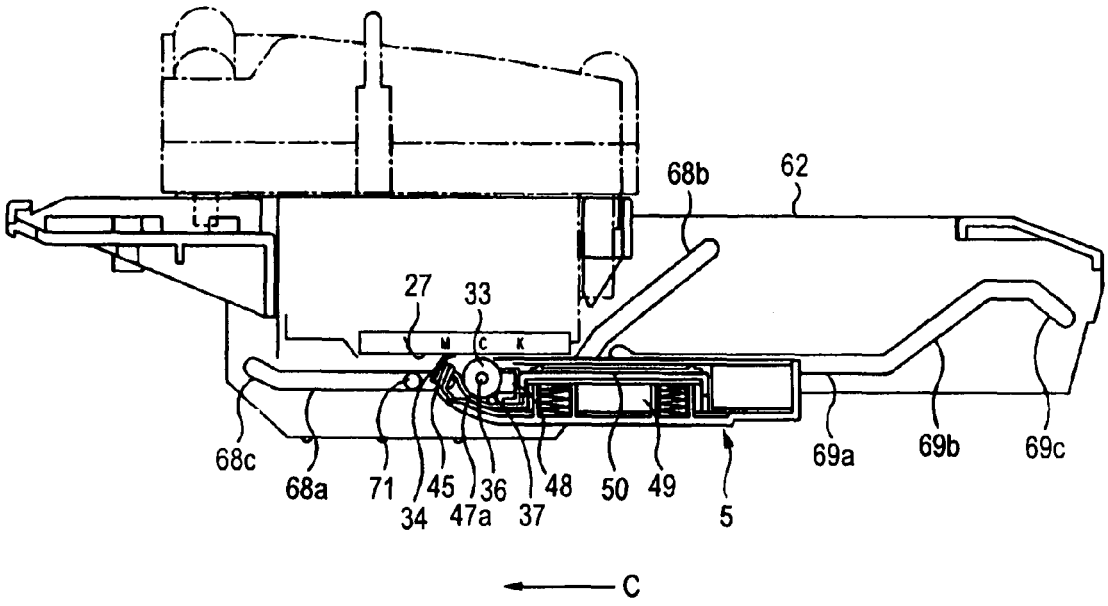
FIG. 16 shows a side view depicting the ink discharge head in the state in which the headcap blocks the head cartridge.

On the ink discharge area 27 of the head cartridge 4, a headcap 5 is detachably disposed which protects the ink discharge area 27 and the ink discharge nozzles 26 from drying. Hereinafter, the headcap 5 will be described with reference to FIGS. 9 to 16. In addition, FIG. 9 shows a plan view depicting the headcap 5, FIG. 10 shows a plan view depicting the headcap shown in FIG. 9 except a cleaning roller 33, a cleaning blade 34, a switching member 35 and a top plate 50, described later, FIG. 11 shows an x-x cross section in FIG. 9, and FIG. 12 shows a y-y cross section in FIG. 9. Furthermore, FIG. 13 shows the initial state in which the headcap 5 blocks the ink discharge area 27 of the head cartridge 4, FIG. 14 shows the state in which the headcap 5 is moved in the open direction in which the head cartridge 4 is opened, FIG. 15 shows the state in which the headcap 5 opens the head cartridge 4, and FIG. 16 shows the state in which the headcap 5 is moved in the block direction in which the head cartridge 4 is blocked.

The headcap 5 is detachably formed with respect to the head cartridge 4, which is relatively movable to the head cartridge 4 by the cap moving mechanism 6, described later. The headcap 5 is moved in an arrow O direction that is the open direction in which the ink discharge area 27 of the head cartridge 4 is opened in printing, it faces the ink discharge area 27 over the transfer area of the paper sheet P, it blocks the ink discharge area 27 when printing is ended, for example, and it is moved in an arrow C direction that is the block direction in which it is mounted on the head cartridge 4 to protect the ink discharge area 27 when printing is finished.

The headcap 5 is formed of a rectangular box with rising pieces therearound, which is formed of a hard resin or the like entirely. On the rear end part of the headcap 5 in the moving direction in which the head cartridge 4 is opened, the headcap 5 has the cleaning roller 33 which cleans the ink discharge nozzles 26 and the ink discharge area 27, the cleaning blade 34, and the switching member 35 which switches the cleaning roller 33 and the cleaning blade 34 so that they are retracted from the ink discharge area 27 alternately. Furthermore, from near the center part to the tip end side in the moving direction the head cartridge 4 is opened, the headcap 5 has a scraper 48 which scrapes off the ink attached to the cleaning roller 33, and an absorbing member 49 which absorbs the ink scraped by the scraper 48, in which they are covered with the top plate 50.

The cleaning roller 33 is a cleaning member which cleans the ink discharge area 27 of the head cartridge 4, and is formed of a material with elasticity in a cylindrical shape. The cleaning roller 33 is mounted on one side part inside the headcap 5 along the longitudinal direction of the headcap 5, and thus it is in parallel with the longitudinal direction of the ink discharge area 27 of the head cartridge 4. Therefore, the cleaning roller 33 is in parallel with the arrangement direction of the ink discharge nozzles 26 formed along the longitudinal direction of the ink discharge area 27 of the head cartridge 4. Furthermore, the cleaning roller 33 is formed in almost the same length as, or longer than the arrangement length of the ink discharge nozzles 26 in the longitudinal direction. Thus, the headcap 5 is moved in the direction orthogonal to the arrangement direction of the ink discharge nozzles 26, whereby the cleaning roller 33 cleans for each of the nozzle lines of the ink discharge nozzles 26.

Figure 18:
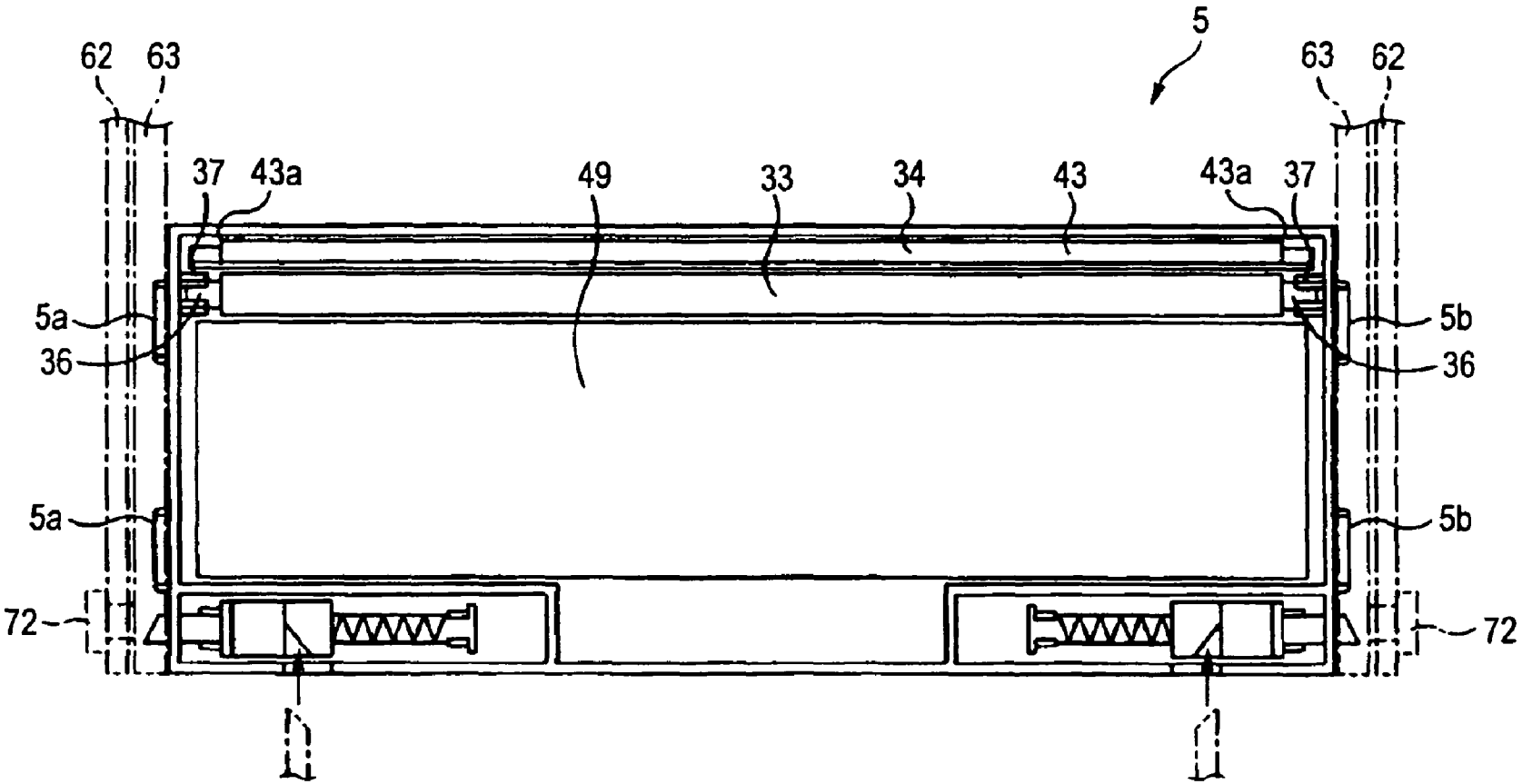
FIG. 18 shows a plan view depicting the headcap supported by a cap moving mechanism.

The cleaning roller 33 is rotatably supported on one side part of the headcap 5, and is detachably mounted thereon as well. In other words, as shown in FIG. 18, at both ends of the cleaning roller 33, a plug 36 is disposed projectingly. As shown in FIG. 18, the plug 36 is rotatably held by a bearing 37 which is erected from the bottom of the headcap 5 in a nearly U-shape. A pin accommodating part in the upper part of the bearing 37 is elastically openable in which the plug 36 is pressed against the pin accommodating part from above, the pin accommodating part is opened to receive the plug 36, and then closed to hold it. In a reverse manner, the plug 36 is lifted upward to open the pin accommodating part, and the plug 36 is removed.

Furthermore, as shown in FIG. 11, the plug 36 has a roller flange 39 in which a coil spring 38 is engaged that energizes the cleaning roller 33 toward the ink discharge area 27 of the head cartridge 4. The roller flange 39 is contacted with the plug 36 on one surface thereof, and a projected engaging part 40 is formed on the other surface thereof, in which the coil spring 38 is engaged in the projected engaging part 40. The coil spring 38 is inserted into a spindle 42 which is erected on the headcap 5 to energize the roller flange 39 upward. Therefore, the cleaning roller 33 receives the energizing force of the coil spring 38 through the roller flange 39, and is energized toward the ink discharge area 27 of the head cartridge 4. In addition, in an embodiment of the invention, instead of the coil spring 38, a plate spring in a nearly U-shape or the like may be used to pressurize and energize the plug 36 upward. In this case, in the plate spring in a nearly U-shape, one end is locked on the bottom of the headcap 5, and the other end is locked on the plug 36, whereby the plate spring biases the plug 36 upward.

Furthermore, the cleaning roller 33 is formed in a nearly cylindrical shape and in a so-called crown shape in which the center part in the longitudinal direction is gradually thickened. This is because the cleaning roller 33 is bent downward in the center part in the longitudinal direction; this event is prevented from occurring that the roller is not contacted with the ink discharge area 27 due to its deformation.

Furthermore, for the portion of the cleaning roller 33 with which the ink discharge area 27 is contacted, the portion has elasticity, and formed of a porous material to absorb liquid, a proper synthetic resin elastic material, for example, including an ethylene propylene rubber, a chloroprene rubber, or a polyurethane rubber. For example, the core of the cleaning roller 33 is formed of a metal or a hard resin. Then, for the cleaning roller 33, the outer layer of the portion contacted with the ink discharge area 27 is soaked in a surface active agent solution.

In addition, the cleaning roller 33 may be formed to have the circumference in cross section in the same length as the distance that the cleaning roller 33 moves over the ink discharge area 27 while it is being driven and rotated as contacted with the ink discharge area 27. In this case, on the outer surface of the cleaning roller 33 driven and rotated over the ink discharge area 27, since the portion that has been contacted to clean the ink discharge nozzle 26 at a predetermined position will not again clean the ink discharge nozzle 26 at another position, the ink discharge nozzles 26 and the ink discharge area 27 can be cleaned stably.

When the headcap 5 shown in FIG. 13 is moved in an arrow O direction shown in FIG. 14 from the initial state in which the headcap 5 blocks the head cartridge 4 to the state in which it opens the ink discharge area 27 shown in FIG. 14, the cleaning roller 33 with elastic force formed in a crown shape receives the energizing force of the coil spring 38, and is contacted with the ink discharge area 27 of the head cartridge 4 in the longitudinal direction in the entire length. Then, the cleaning roller 33 is further moved in the open direction of the ink discharge area 27 as it is contacted with the ink discharge area 27, whereby it is driven and rotated, or slid over the ink discharge area 27, and it absorbs the ink i remaining in the ink discharge area 27 and the ink discharge nozzles 26. At this time, since the cleaning roller 33 has the outer layer that is contacted with the ink discharge area 27 soaked in the surface active agent solution, it has excellent wettability to ink. Upon the cleaning roller 33 being contacted with the ink discharge nozzles 26, an ink layer is instantaneously formed between the cleaning roller 33 and the ink discharge area 27, and the ink with increased viscosity is again solved by the ink in the layer. After solved again, the ink is absorbed by the cleaning roller 33 with high wettability, and the ink can be cleaned easily. The headcap 5 is moved from the block position of the head cartridge 4 shown in FIG. 13 to the open position of the head cartridge 4 shown in FIG. 15, whereby the cleaning roller 33 can clean the ink discharge area 27 of the head cartridge 4 throughout the area.

Furthermore, when the headcap 5 is moved in an arrow C direction in FIG. 16 in which it blocks the ink discharge area 27, the plug 36 is pressed downward by the switching member 35, described later, against the energizing force of the coil spring, and the cleaning roller 33 is retracted from the ink discharge area 27. More specifically, when the cleaning roller 33 is driven and rotated over the ink discharge area 27 after printing, it unnecessarily absorbs unused ink stored in the ink liquid chamber 32, causing uneconomic costs, and the absorbing performance of the cleaning roller 33 is deteriorated to shorten the lifetime of the cleaning roller 33. However, in the printing apparatus 1 to which an embodiment of the invention is adapted, the cleaning roller 33 is retracted from the ink discharge area 27 for no cleaning when the head cartridge 4 is blocked, whereby such an event can be prevented.

Next, the cleaning blade 34 disposed on the left side near the cleaning roller 33 in FIG. 9 will be described. The cleaning blade 34 is a wiping member which wipes off attached ink residue with increased viscosity and waste while it is moving over the ink discharge area 27 of the head cartridge 4. As shown in FIGS. 11 and 12, the blade has a wipe part 43 formed of an elastic member in a sheet such as a rubber that is pressed against the ink discharge area 27 and deformed, and a supporting plate 44 which supports the wipe part 43, in which the supporting plate 44 is rotatably mounted on the headcap 5 in the moving direction on the bottom side of the headcap 5 through a holder 45. As similar to the cleaning roller 33, the cleaning blade 34 is mounted on the headcap 5 in the longitudinal direction, and is in parallel with the ink discharge area 27 of the head cartridge 4 in the longitudinal direction. When the headcap 5 is moved, the cleaning blade 34 is pressed against the ink discharge area 27, deformed and slide to wipe off the ink hardened with increased viscosity and waste attached to the ink discharge area 27.

The wipe part 43 which is slid over the ink discharge area 27 is formed in which a synthetic resin such as a rubber is molded in a nearly rectangular shape, and then the outer rim is cutoff. Thus, the wipe part 43 has nearly square corners, and reliably wipes off the thickened ink and waste attached on the ink discharge area 27. The supporting plate 44 which supports the wipe part 43 is formed of a hard material such as a metal plate, and it is formed in which it is placed in a predetermined mold, a synthetic resin of a row material for the wipe part 43 is cast into the mold and removed out of the mold, and then the supporting plate is formed in one piece with the wipe part 43.

The holder 45 which rotatably supports the support part 44 is rotatably mounted on the bottom of the headcap 5 in the moving direction of the headcap 5, and rotatably holds the cleaning blade 34. The holder 45 is formed in a near L-shape in cross section in which the supporting plate 44 is mounted on one side, and the other end of a helical torsion spring 46 whose one end is locked on the headcap 5 is locked on the other side. Therefore, the holder 45 is rotatably energized in an arrow R direction in FIG. 11 to which the wipe part 43 is faced over the ink discharge area 27 all the time.

Then, when the headcap 5 is moved by the cap moving mechanism 6, described later, from the initial state shown in FIG. 13 in which the headcap 5 blocks the head cartridge 4 to the arrow O direction in FIG. 14 in which it opens the head cartridge 4, the holder 45 is rotated by the switching member 35, described later, in an arrow R direction in reverse in FIG. 11, and the wipe part 43 of the cleaning blade 34 is retracted from the ink discharge area 27. Furthermore, when the headcap 5 is moved from the open position of the head cartridge 4 shown in FIG. 15 to the arrow C direction in FIG. 16 in which it blocks the head cartridge 4, the energizing force is released by the switching member 35, described later, the cleaning blade 34 is rotated by the energizing force of the helical torsion spring 46 in an arrow R direction in FIG. 11, and the wipe part 43 is faced over the ink discharge area 27. Then, the headcap 5 is moved to slide the wipe part 43 over the ink discharge area 27, and the wipe part 43 wipes off the ink and waste attached on the ink discharge area 27.

At this time, the holder 45 is supported by the stopper blade 47 in order to prevent the cleaning blade 34 from excessively leaning against the bottom of the headcap 5 due to the slide over the ink discharge area 27. The stopper blade 47 is formed of an elastic member such as a plate spring in a nearly rectangular plate, and then it is disposed on the rear end part of the headcap 5 in the longitudinal direction. The stopper blade 47 has a support part 47*a* for supporting which is contacted with the surface on the opposite side of the surface on which the supporting plate 44 of the holder 45 is mounted. The tip end of the support part 47*a* is extended to the area in which the holder 45 is rotated. When the wipe part 43 is slid and contacted with the ink discharge area 27 and the holder 45 leans against in an arrow R direction in FIG. 12, the support part 47*a* is contacted with the holder 45, and the stopper blade 47 prevents the cleaning blade 34 from further leaning against in an arrow R direction. Therefore, the stopper blade 47 can prevent the cleaning blade 34 from excessively leaning, and the wipe part 43 is slid and contacted with the head cartridge 4 at a constant pressure. Thus, the cleaning efficiency of the ink discharge area 27 the wipe part 43 can be prevented from being deteriorated.

Figure 17:
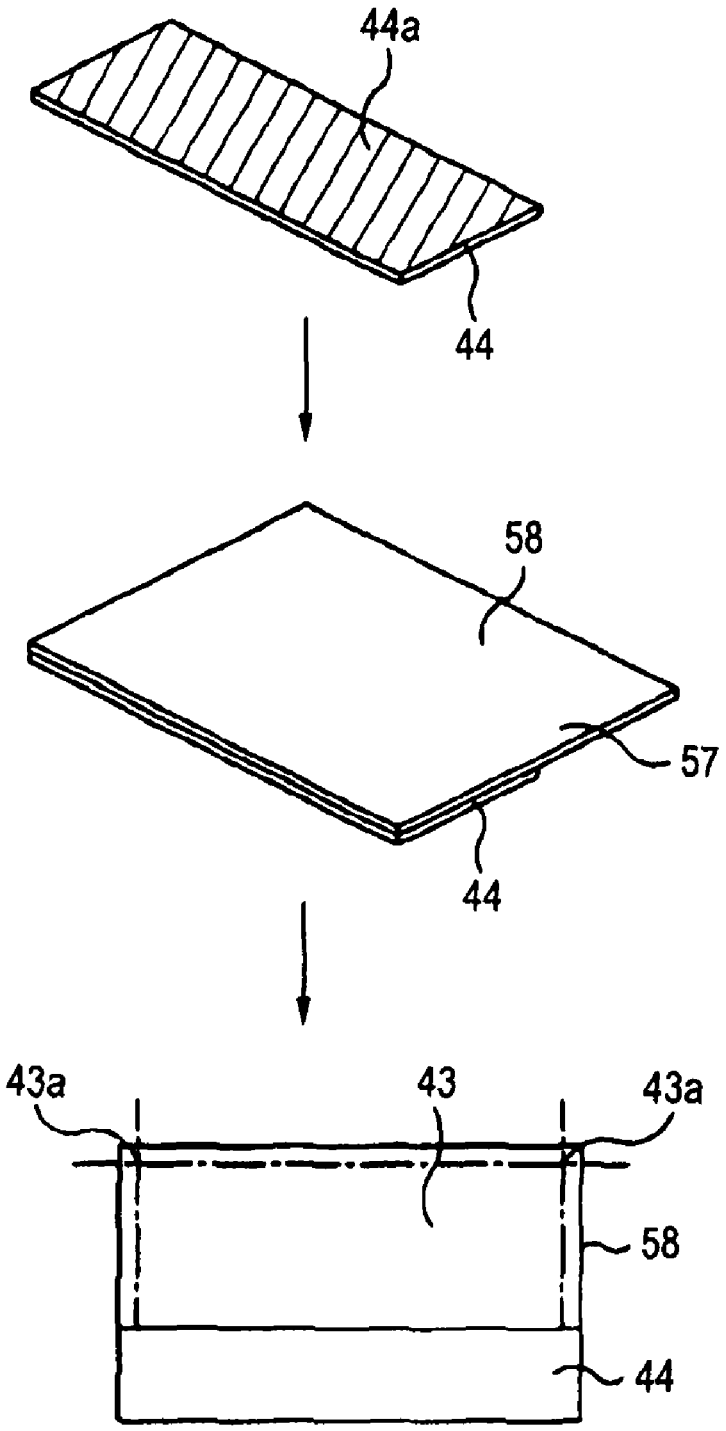
FIG. 17 shows a diagram depicting the fabrication process steps of the cleaning blade.

The cleaning blade 34 having the configuration described above is formed in which the supporting plate 44 in a rectangular plate formed of a hard material such as a metal plate is placed in a mold slightly greater than the shape of the wipe part 43, and a polymeric material for the material of the wipe part 43 is cast to form them in one piece. At this time, as shown in FIG. 17, in the supporting plate 44, an adhesive agent is coated over the surface contacting with the wipe part 43 in advance to form an adhesive agent layer 44*a*. Then, the polymeric material cast into the mold is hardened to obtain a blade plate 58 in which an elastic part 57 configuring the wipe part 43 and the supporting plate 44 are formed in one piece.

For the polymeric material configuring the wipe part 43, rubber materials such as natural rubbers, hydrocarbon rubbers, chloroBullen synthetic rubbers, nitrile rubbers, fluororubbers, and silicon rubbers may be used. Furthermore, for the supporting plate 44, a metal such as stainless steel, aluminum, copper, nickel, iron or an alloy thereof may be used. In addition, the supporting plate 44 is formed with an insertion hole through which the plate is mounted on the holder 45. The supporting plate is mounted on the holder 45, whereby the wipe part 43 can be contacted with the ink discharge area 27 at a predetermined angle.

The blade plate 58 is formed with the elastic part 57 in one piece. The elastic part 57 configures the wipe part 43 in the entire length of the supporting plate 44 formed slightly longer than the length of the nozzle line 26*y* to 26*k* in the longitudinal direction formed in the ink discharge area 27 of the head cartridge 4. The polymeric material hardened to form the elastic part 57 is formed in a nearly rectangular plate, and the lower end part in the short length direction is joined to the adhesive agent layer 44*a* of the supporting plate 44 in the entire length in the longitudinal direction.

Subsequently, for the blade plate 58, the elastic part 57 is cut into a predetermined shape in accordance with the design size of the wipe part 43 to form the wipe part 43. At this time, for the blade plate 58, in order to obtain the dimensional accuracy of the wipe part 43 as well as the sharpened edge of the tip end of the wipe part 43, the distance from the base end part of the supporting plate 44 to the tip end part of the wipe part 43 is secured, and then the tip end of the wipe part 43 is cut vertically by a cutter. After that, the supporting plate 44 is mounted on the holder 45 which is rotatably supported by the headcap 5, and thus the cleaning blade 34 is formed.

Since in the cleaning blade 34 like this, the supporting plate 45 formed of a hard material such as a metal plate is formed in one piece with the wipe part 43, the blade has stiffness in the entire length in the longitudinal direction. Furthermore, the supporting plate 44 is formed in one piece with the elastic part 57 configuring the wipe part 43, and then the piece is cut depending on the shape of the wipe part 43. Therefore, the flatness of the tip end part of the wipe part 43 can be secured highly accurately. Since the elastic part 57 is cut after punched out to form the wipe part 43, two corner parts 43*a* in the longitudinal direction of the wipe part 43 can be formed square. Moreover, the wipe part 43 is formed in one piece with the supporting plate 44, and then the supporting plate 44 is mounted on the holder 45. Thus, the mounting accuracy can be obtained easily.

Therefore, according to the cleaning blade 34, the flatness and the stiffness are provided highly accurately in the entire length of the wipe part 43. Thus, the thickened ink and waste such as paper dust attached on the ink discharge area 27 can be surely wiped off in the overall width of the ink discharge area 27. In addition, since the two corner parts 43*a* in the longitudinal direction of the wipe part 43 are cut square, the cleaning performance is not deteriorated on the both ends in the width direction of the ink discharge area 27. In addition, the cleaning blade 34 has a sufficient joining strength between the supporting plate 44 and the wipe part 43 because they are formed in one piece, and it maintains the durability for along time. Therefore, it can maintain dimensional accuracy for a long time.

Furthermore, for the cleaning blade 34, a plurality of slits 59 may be formed by forming cuts in the tip end part 43*b* of the wipe part 43 in accordance with design. The slits 59 are formed in which cuts are formed in the tip end part of the wipe part 43 whose base end part is supported by the supporting plate 44. Thus, the slit width between adjacent wipe pieces 43*b* of the wipe part 43 is about 10 μm.

Figure 19:
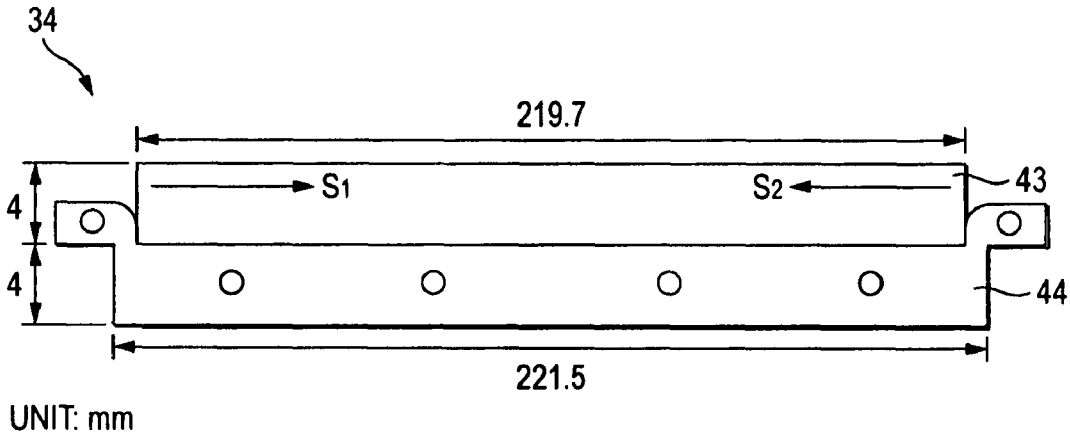
FIG. 19 shows a plan view depicting a cleaning blade.
Figure 20:
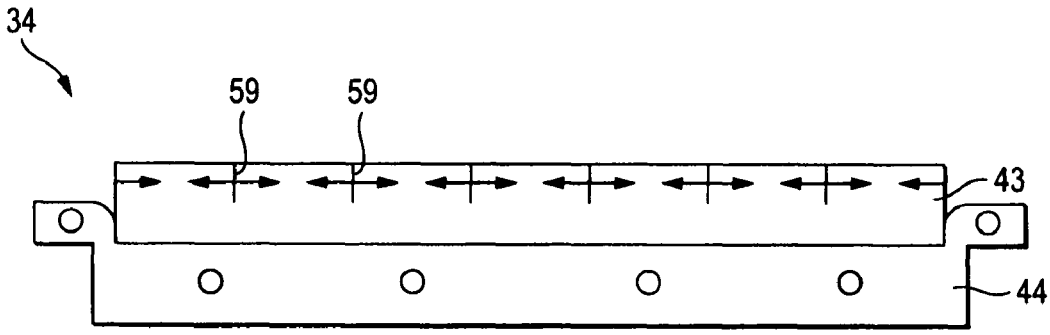
FIG. 20 shows a plan view depicting a cleaning blade formed with slits.

In the cleaning blade 34, the supporting plate 44 is formed in one piece with the elastic part 57, and then the elastic part 57 is cut in a predetermined shape to form the wipe part 43. The base end part of the wipe part 43 is supported by the supporting plate 44, and the supporting plate 44 formed of a metal plate and the wipe part 43 have different linear expansion coefficients. Thus, stresses occur inside the wipe part 43 formed of a synthetic resin, and cuts are formed therein to cause the stresses to work in the direction in which the stresses contract to each other in two cut areas of the wipe pieces 43*a*. This is the reason why the slits 59 are formed. More specifically, as shown in FIG. 19, internal stresses work in the wipe part 43 of the blade plate 58 so that the stresses contract inward to each other in the longitudinal direction as indicated by arrows S1 and S2 in FIG. 19, due to the contraction that a rubber material inherently has. Such stresses are controlled by the supporting plate 44 which supports the base end part of the wipe part 43. When cuts are formed in the tip end part of the wipe part 43 in the direction orthogonal to the longitudinal direction as contractive force in the longitudinal direction is controlled as described above, as shown in FIG. 20, stresses to contract inward work in the wipe part 43 in each cut area. Thus, the slits 59 are uniformly formed in the longitudinal direction.

Figure 21:
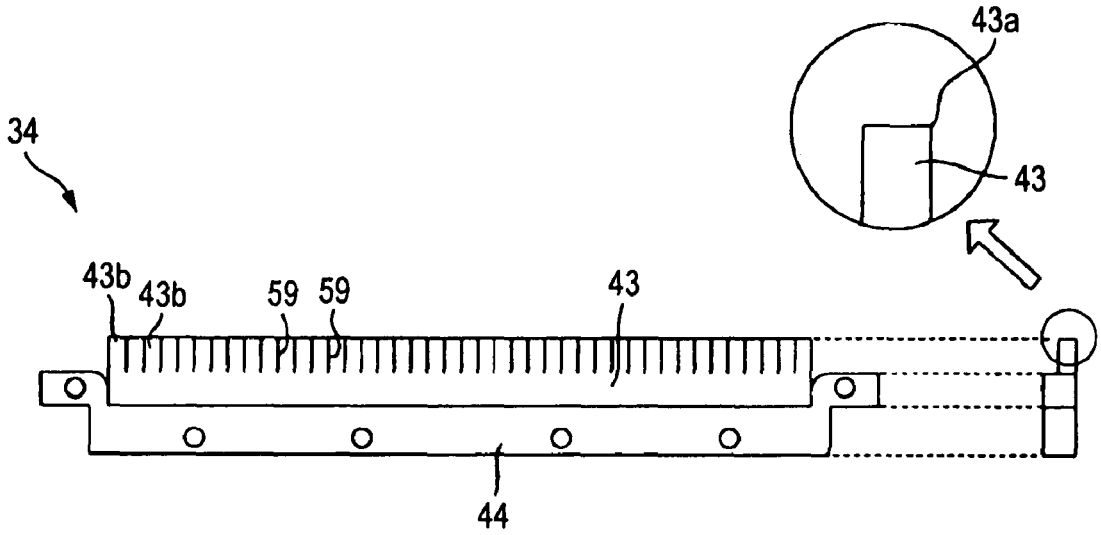
FIG. 21 shows a plan view depicting a cleaning blade formed with slits.

In addition, in the implementation, EPDM was used for a synthetic resin, and a stainless steel was used for the supporting plate 44. Furthermore, the dimensions of each part of the cleaning blade 34 in the implementation are as shown in FIG. 19. In addition, in the supporting plate 44, an insertion hole is formed at a plurality of places in the longitudinal direction to screw the supporting plate 44 to the holder 45. Furthermore, the supporting plate 44 supports the base end part of the wiping member 43 in the longitudinal direction as well as supports both side surface portions to support the supporting plate 44 as surrounded by three areas, whereby the stiffness and the flatness of the wiping member 43 are secured. Then, for the cleaning blade 34, cuts are formed at predetermined intervals in a predetermined depth, and then a plurality of the slits 59 is formed as shown in FIG. 21. The slit width was about 10 μm.

According to the cleaning blade 34 formed with a plurality of the slits 59, stresses to contract inward work in the wipe pieces 43*b* each separated by the slit 59 formed in the wipe part 43. Therefore, the ink discharge area 27 can be surely cleaned without the occurrence of these events such that the cut areas in the wipe piece 43*b* are closely contacted with each other, and that the adjacent wipe pieces 43*b* are overlapped with each other. Furthermore, the width of the slit 59 formed in the wipe part 43 is about 10 μm, and it is smaller than the diameter of the ink discharge nozzle 26 formed in the ink discharge area 27 (about 14 μm to 16 μm). Therefore, at least the wipe piece 43 is partially slid and contacted with the ink discharge nozzles 26. Accordingly, the cleaning blade 34 can surely wipe off residues such as ink and foreign substances attached on the ink discharge nozzles 26.

Figure 22:
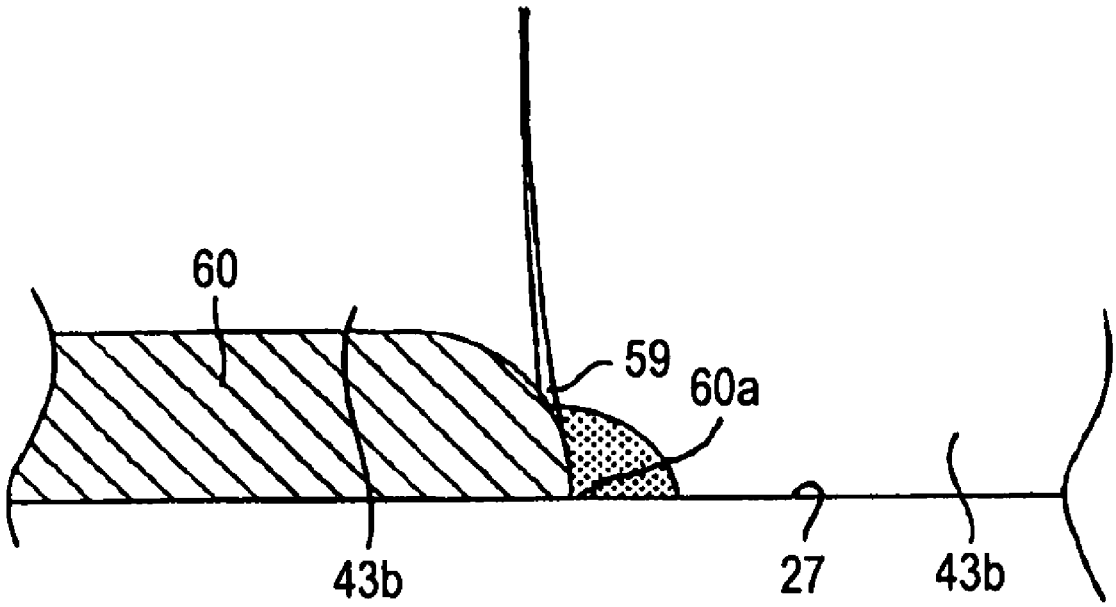
FIG. 22 shows a diagram depicting a cleaning blade which cleans near a wire bonding.
Figure 23:
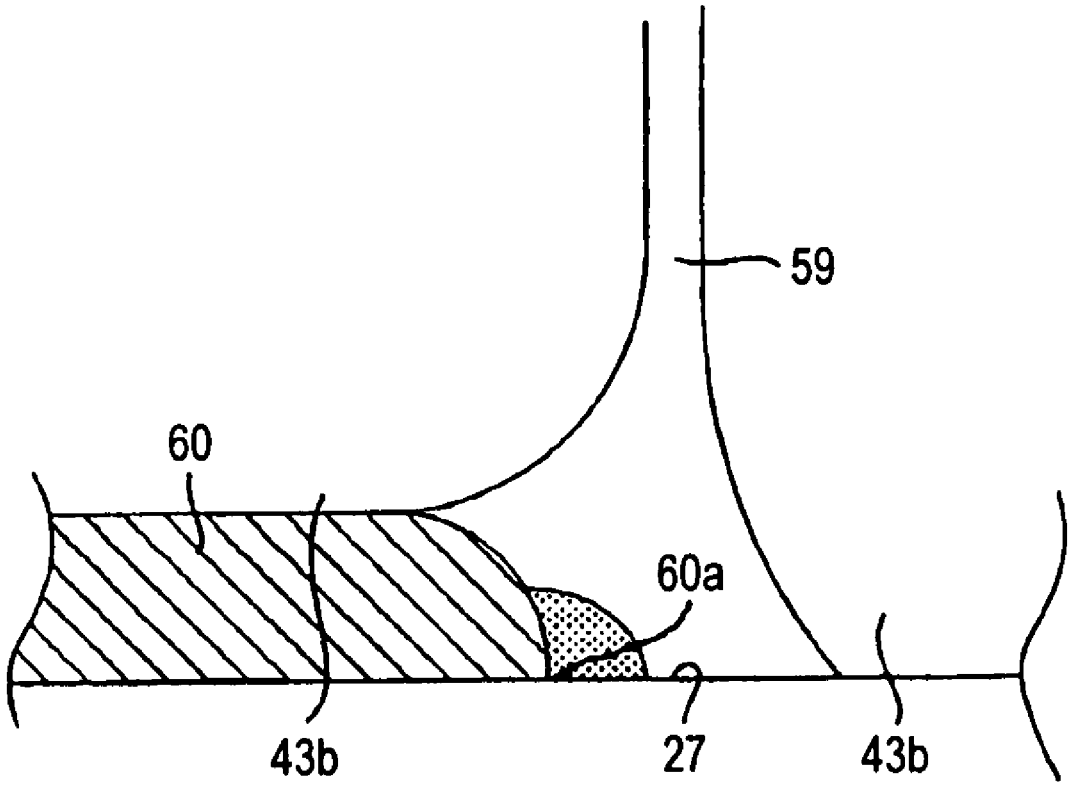
FIG. 23 shows a diagram depicting a cleaning blade which is difficult to sufficiently clean the vicinity of a wire bonding.

Furthermore, as shown in FIG. 22, the cleaning blade 34 formed with a plurality of the slits 59 is slid and contacted over a wire bonding 60 projected on the ink discharge area 27, and can surely wipe off residues such as ink and foreign substances over a border part 60*a*, because the slit 59 and another adjacent wipe piece 43*b* are placed at the border part 60*a* between the wire bonding 60 and the ink discharge area 27. Here, in the cleaning blade 34 to which an embodiment of the invention is adapted, the slit 59 disposed between the wipe pieces 43*b* is formed in narrow width of about 10 μm as described above. Therefore, when a single wipe piece 43*b* is slid and contacted over the projected wire bonding 60, the adjacent wipe piece 43*b* can scrape off residues in the border part 60*a* between the wire bonding 60 and the ink discharge area 27. Furthermore, the cleaning blade 34 can wipe off residues throughout the area of the ink discharge area 27. On the other hand, when the slit 59 has wide width, as shown in FIG. 23, a wipe pieces 43*b* adjacent to the wipe piece 43*b* slid and contacted over the wire bonding 60 does not reach residues in the border part 60*a* to the ink discharge area 27, and it is difficult to surely wipe the ink discharge area 27 as well as it is difficult to wipe off waste and ink residues with the slit throughout the area of the ink discharge area 27.

Figure 24:
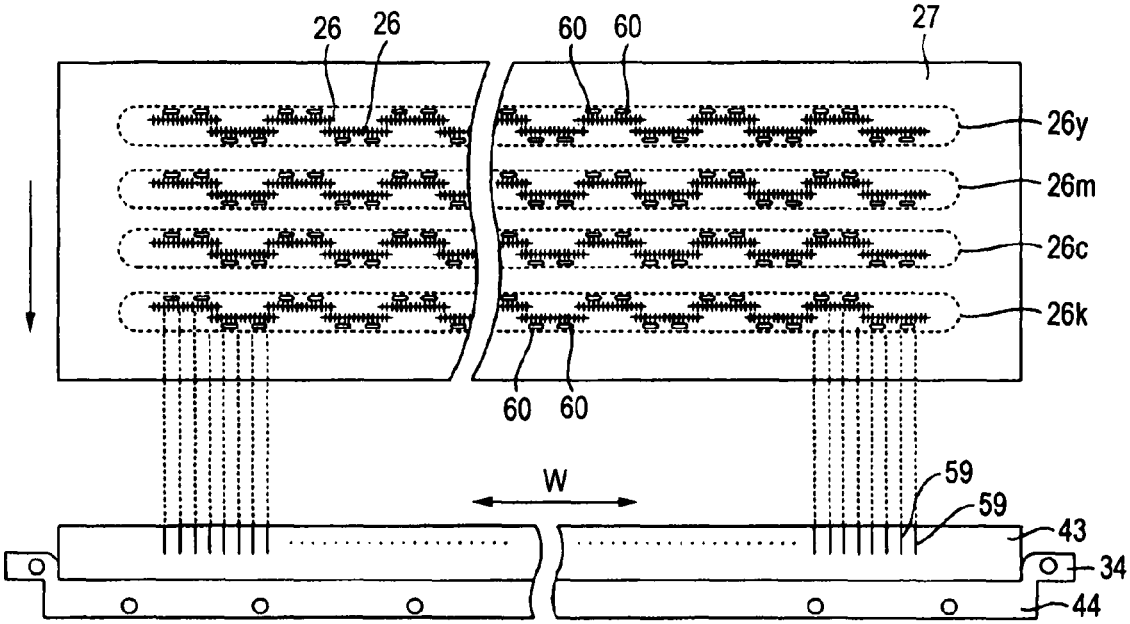
FIG. 24 shows a diagram depicting a cleaning blade formed with slits in accordance with positions at which wire bondings are formed.

Furthermore, as shown in FIG. 24, in the cleaning blade 34, the slits 59 may be formed as they correspond to the places at which the wire bondings 60 are intermittently projected at equal intervals on the ink discharge area 27. More specifically, the wire bondings 60 are formed at equal intervals for each of the nozzle lines 26*y*, 26*m*, 26*c*, and 26*k* and at the positions not overlapped with each other in the direction orthogonal to the longitudinal direction of the ink discharge area 27 (see FIG. 7). Therefore, cuts are formed at intervals to form the slits 59 at the positions correspondingly to the positions at which the wire bondings 60 are formed so that the slits 59 are also positioned at any of the border parts 60*a* of the wire bondings 60. Accordingly, a single wipe piece 43*b* is slid and contacted over the wire bonding 60, and the wipe pieces 43*b* adjacent thereto can be slid and contacted with the border part 60*a*. In addition, the interval to form the wire bonding 60 and the interval to form the slit 59 may be identical, or the slit 59 may be formed at intervals at which the slit 59 is positioned correspondingly to the position of the wire bonding 60 while a single or a plurality of the slits 59 are in between. Accordingly, the cleaning blade 34 can wipe off residues such as ink and foreign substances in the wire bonding 60 and the border part 60*a* throughout the area of the ink discharge area 27.

In addition, in the cleaning blade to which an embodiment of the invention is adapted, the supporting plate 44 is formed in one piece with the elastic part 57 to obtain the blade plate 58. However, this scheme may be done in which a supporting plate 44 and an elastic part 57 are separately formed and joined to form a blade plate 58, and the blade plate 58 is cut in predetermined size.

Next, the switching member 35 which switches the cleaning roller 33 and the cleaning blade 34 will be described. The switching member 35 is formed between the cleaning roller 33 and the cleaning blade 34, which switches to retract the cleaning roller 33 and the cleaning blade 34 alternately from the ink discharge area 27 depending on the headcap 5 opening, closing, and moving, the cleaning roller 33 and the cleaning blade 34 are energized to rotatably or slidably move over the ink discharge area 27. The switching member 35 has a switch 51 which presses the plug 36 of the cleaning roller 33 and the holder 45 of the cleaning blade 34, and a switch spring 52 which erects and energizes the switch 51.

The switch 51 is bent in a nearly inverted-V shape, and has a support hole 53 perforated at the lower end part thereof, in which the support hole 53 is inserted with a rotatable pin projected on a support piece erected from the bottom of the headcap 5, and the switch 51 is supported rotatably in an arrow S direction and in a reverse direction of the arrow S in FIG. 11 which are the moving directions of the headcap 5. In addition, the switch 51 has a lock hole 54 perforated below the support hole 53, in which the switch spring 52 is locked.

The switch spring 52 is formed with a lock part 55 which locks in the lock hole 54 of the switch 51, and a the ring part 56 which locks in a lock pin projected from a support piece erected from the bottom of the headcap 5. The switch spring 52 energizes the switch 51 downward to rotate the switch 51 in the erected direction all the time in which the switch 51 is not contacted with either the plug 36 or the holder 45 as the lock hole 54 is a rotating center.

When the headcap 5 is moved in the arrow O direction in FIG. 14 in which the headcap 5 opens the ink discharge area 27, the switch 51 is pressed against the ink discharge area 27 to rotate the switching member 35 in the reverse direction of the arrow S in FIG. 11 against the energizing force of the switch spring 52. Therefore, by the switch 51, one side surface 51*a* on the cleaning blade 34 side presses the holder 45 to rotate the cleaning blade 34 in the reverse direction of the arrow R direction in FIG. 11 against the energizing force of the helical torsion spring 46, and the wipe part 43 is retracted from the ink discharge area 27. On the other hand, since the plug 36 is not pressed by the switch 51, the cleaning roller 33 is faced over the ink discharge area 27 with the energizing force of the coil spring 38 so that it is contactable with area. Therefore, when the headcap 5 is moved in the arrow O direction in FIG. 14 in which the headcap 5 opens the ink discharge area 27, it is switched such that only the cleaning roller 33 cleans the ink discharge area 27 whereas the cleaning blade 34 does not clean the area. Thus, since the excessive slide of the cleaning blade is suppressed after cleaned by the cleaning roller 33, the ink discharge nozzles 26 and the ink discharge area 27 can be protected, and the cleaning blade 34 can be prevented from deteriorating.

In addition, when the headcap 5 is moved in the arrow C direction in FIG. 16 in which the headcap 5 blocks the ink discharge area 27, the switch 51 is pressed against the ink discharge area 27 to rotate the switching member 35 in an arrow S direction in FIG. 11 against the energizing force of the switch spring 52. Therefore, an other side surface 51*b* on the roller side of the switch 51 presses the plug 36 to retract the cleaning roller 33 from the ink discharge area 27 against the energizing force of the coil spring 38. On the other hand, since the holder 45 is not pressed by the switch 51, the cleaning blade 34 is faced over the ink discharge area 27 with the energizing force of the helical torsion spring 46 so that it is contactable with the area. Accordingly, when the headcap 5 is moved in the arrow C direction in FIG. 16 in which the headcap 5 blocks the ink discharge area 27, it is switched such that only the cleaning blade 34 cleans the ink discharge area 27 whereas the cleaning roller 33 does not clean the area.

Here, as described above, the switch 51 is bent in a nearly inverted-V shape, whereby the other side surface 51*b* on the cleaning roller 33 side is formed in a recessed shape. Therefore, when the switch 51 is rotated in an arrow S direction in FIG. 11 on the cleaning roller 33 side, the other side surface 51*b* in a recessed shape can be reliably locked in the plug 36 of the cleaning roller 33 to press it, and the cleaning roller 33 can be retracted from the position at which it is slid and contacted with the ink discharge area 27.

Furthermore, the switch 51 has the one side surface 51*a* on the cleaning blade 34 side which is expanded in an arc shape. Therefore, when the switch 51 is rotated in the reverse direction of the arrow S in FIG. 11 on the cleaning blade 34 side, the one side surface 51*a* expanded in an arc shape gradually presses the holder 45 to smoothly rotate the holder 45, and the wipe part 43 can be retracted from the position at which it is slid and contacted with the ink discharge area 27.

Furthermore, the switch 51 has a peak formed in an arc shape which is slid and contacted with the ink discharge area 27. Therefore, the switch 51 is smoothly rotated with no damage on the ink discharge area 27 even though it is slid and contacted with the ink discharge area 27.

Next, the scraper 48, the absorbing member 49 and the top plate 50 which remove foreign substances such as waste on the cleaning roller 33 will be described. The scraper 48 is formed of a sponge, for example, with fine projections and depressions in order to easily remove foreign substances on the surface of the cleaning roller 33, which can slightly absorb ink on the surface of the cleaning roller 33, and the scraper 48 is formed in a nearly rectangular shape, disposed in the longitudinal direction of the headcap 5. The scraper 48 is disposed near the center of the headcap 5, and is placed at the position at which it can be slid and contacted with the cleaning roller 33 in the longitudinal direction. The cleaning roller 33 which has absorbed the ink attached to the ink discharge nozzles 26 and the ink discharge area 27 is slid and rotated, and then the scraper 48 scrapes off foreign substances such as ink residues and waste attached on the cleaning roller 33. The scraper 48 is contacted with the absorbing member 49, and the ink absorbed by the cleaning roller 33 is absorbed and retained in the absorbing member 49.

The absorbing member 49 is formed of a nonwoven fabric, for example, which can absorb and retain ink, and is formed in a sheet, whereby it is disposed in the longitudinal direction of the headcap 5. The absorbing member 49 is disposed on the tip end side in the moving direction in which the headcap 5 opens the head cartridge 4. The absorbing member 49 has capillary attraction greater than the scraper 48 has, which absorbs and retains the ink scraped by the scraper 48. Therefore, the cleaning roller 33 and the scraper 48 can maintain the cleaning performance for the ink discharge nozzles 26 and the ink discharge area 27 without saturating the absorbed ink. In addition, the absorbing member 49 is widely disposed from near the center of the headcap 5 to the tip end part, and can absorb and retain a considerable amount of ink.

In addition, since the top of the absorbing member 49 is covered with the top plate 50, the absorbing member 49 is not directly faced to the ink discharge area 27 of the head cartridge 4 even though the headcap 5 blocks the head cartridge 4, and the ink discharge area 27 is not soiled with the ink absorbed and retained in the absorbing member 49.

In addition to this, the headcap 5 has a waste ink tray on the bottom between the cleaning roller 33 and the cleaning blade 34. The waste ink tray is formed of a sheet of a moisture absorption material such as a sponge that can absorb ink. In order to stabilize the ink discharge performance from the ink discharge nozzles 26, after cleaned by the cleaning roller 33, the waste ink tray absorbs the waste ink liquid taken out in the discharge performed prior to printing.

Figure 25:
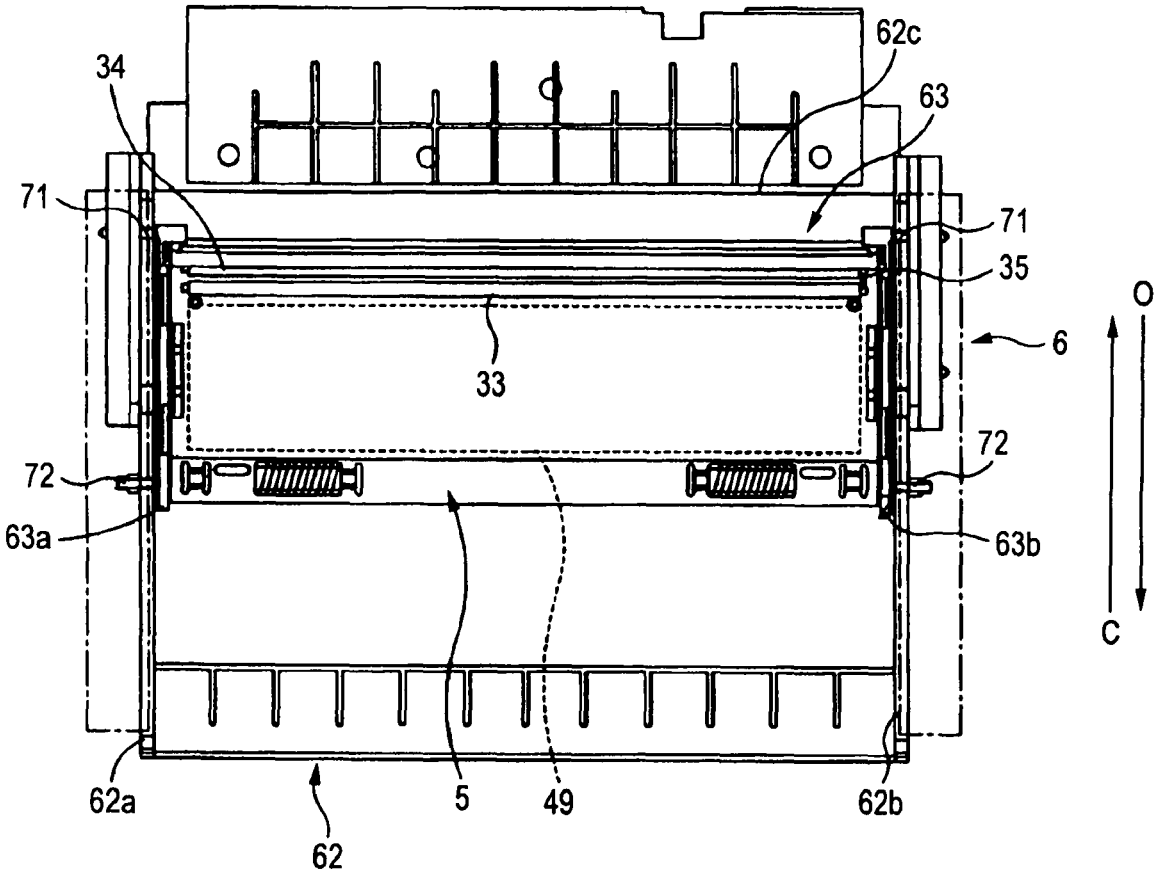
FIG. 25 shows a plan view depicting a cap moving mechanism.

Next, the cap moving mechanism 6 which moves the headcap 5 in the open/close direction of the head cartridge 4 will be described. As shown in FIGS. 3 and 25, the cap moving mechanism 6 has a support frame member 62 which is assembled on a side part 61 of a chassis arranged inside the printer main body 2, a headcap holder 63 which is slidably assembled in the back-and-forth direction of the printer main body 2 with respect to the support frame member 62, a rack plate 64 which is moved in the back-and-forth direction of the printer main body 2 between the chassis side part 61 and the support frame member 62, and a drive motor 65 which moves the rack plate 64 through a worm gear 66.

The support frame member 62 is a member in a nearly frame shape in one piece formed of a synthetic resin, which is fixed to the chassis disposed inside the printer main body 2. The support frame member 62 supports the headcap holder 63, described later, which movably holds the headcap 5 in the back-and-forth direction of the printer main body 2, having the length reaching from the print position of the printer main body 2 to the front side.

Figure 26:
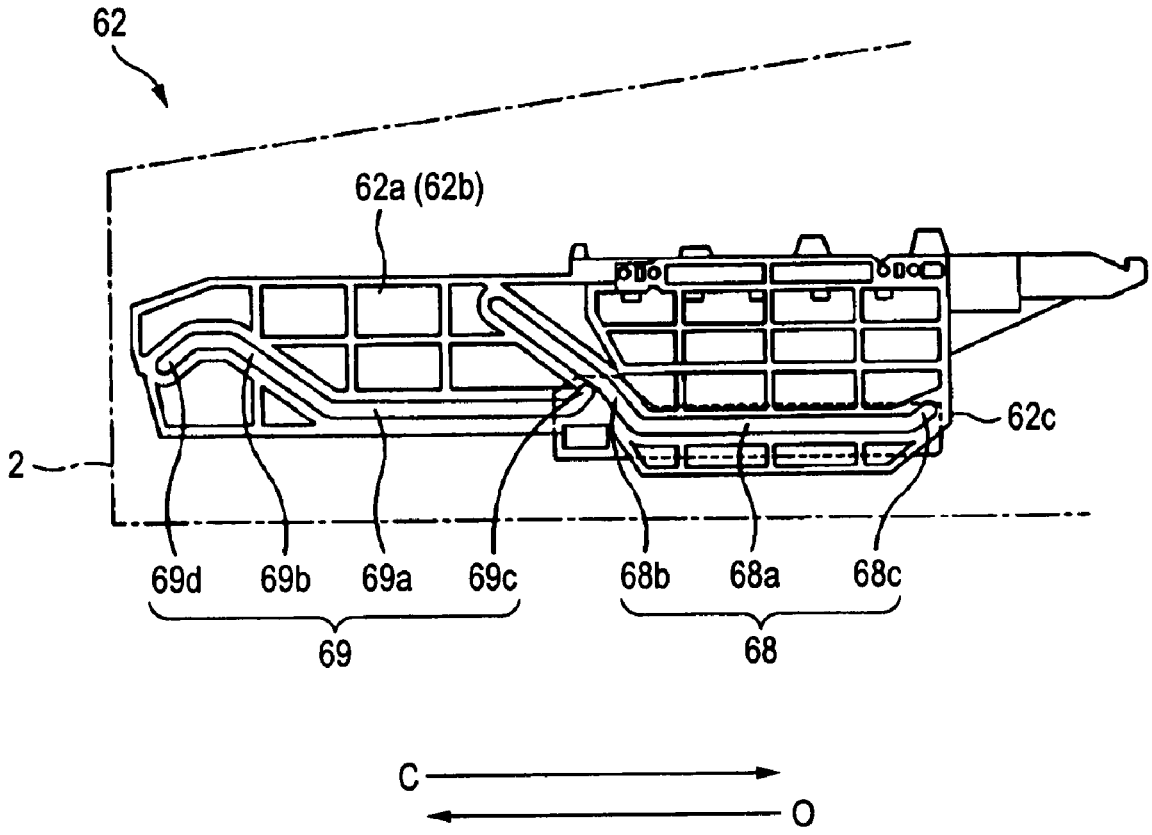
FIG. 26 shows a side view depicting a support frame member.

As shown in FIG. 26, the support frame member 62 has two side surface parts 62*a* and 62*b* in the back-and-forth direction, in which a first guide groove 68 and a second guide groove 69 are formed in a pair of symmetrical through grooves. The first guide groove 68 is formed in accordance with the print position of the printer main body 2, which is formed of a horizontal groove 68*a* that is horizontally extended from near a side part 62*c* on the back side of the printer main body 2 to the front side, and a tilt groove part 68*b* that communicates in the front end part of the horizontal groove 68*a* and tilts upward toward the front side. In addition, the horizontal groove 68*a* tilts upward in which the rear end part 68*c* faces to the back side. The second guide groove 69 has a horizontal groove 69*a* which is horizontally extended toward the front side starting from near the base end part at which the tilt groove part 68*b* of the first guide groove 68 rises near the center part of the both side surface parts 62*a* and 62*b*, a tilt groove part 69*b* which communicates in the front end part of the horizontal groove 69*a* and tilts upward toward the front side, and a curve part 69*d* which curves from the tip end of the tilt groove part 69*b* and tilts downward. In addition, the horizontal groove 69*a* also tilts upward in which the rear end part 69*c* faces to the back side.

The support frame member 62 is formed in which the first guide groove 68 and the second guide groove 69 have an interval of almost equal length between the rear end parts 68*c* and 69*c* of the horizontal grooves 68*a* and 69*a*, and have the length almost the same as the length in the depth direction orthogonal to the width direction of the headcap 5, described above. The support frame member 62 is formed in which the first guide groove 68 and the second guide groove 69 have the length of an interval between the front end of the tilt groove part 69*b* and the front end of the curve part 69*d* almost equal to the length in the depth direction of the headcap 5.

The headcap holder 63 whose movement in the back-and-forth direction of the printer main body 2 is supported by the support frame member 62 is formed in a nearly frame shape in the overall form in which a plurality of metal beams sustains the interval between the side parts 63*a* and 63*b* molded of a synthetic resin facing each other. The headcap holder 63 is mounted with the headcap 5, whereby it moves the headcap 5 in the back-and-forth direction of the printer main body 2 along the first guide groove 68 and the second guide groove 69 of the support frame member 62, respectively.

The headcap holder 63 has guide grooves (not shown) in the horizontal direction formed on the inner surfaces of the side parts 63*a* and 63*b*, the guide grooves in which guide projecting parts 5*a* and 5*b* (see FIG. 18) projected from the headcap 5 are locked. The guide groove is each opened toward the front of the side parts 63*a* and 63*b* of the headcap holder 63. The guide projecting parts 5*a* and 5*b* are inserted through the openings to assemble the headcap 5.

In addition, as shown in FIG. 25, the headcap holder 63 has a first guide bearing 71 and a second guide bearing 72 formed protrusively separately on the side parts 63*a* and 63*b* in the back-and-forth direction. In the headcap holder 63, the first guide bearing 71 is fit into the first guide groove 68 of the support frame member 62, and the second guide bearing 72 is fit into the second guide groove 69 of the support frame member 62. Therefore, the headcap holder 63 is guided by the support frame member 62, and slidable in the back-and-forth direction of the printer main body 2.

More specifically, when the first guide bearing 71 is positioned at the rear end part 68*c* of the first guide groove 68 and the second guide bearing 72 is positioned at the rear end part 69*c* of the second guide groove 69, the headcap holder 63 retains the headcap 5 at the block position at which the ink discharge area 27 of the head cartridge 4 is blocked. When the first and second guide bearings 71 and 72 are moved to the front side inside the first and second guide grooves 68 and 69 and are positioned above the tilt groove parts 68*b* and 69*b*, respectively, the headcap holder 63 retains the headcap 5 at the retract position at which the ink discharge area 27 of the head cartridge 4 is opened.

In addition, the headcap holder 63 may be moved from the retract position further to the front side to clean the cleaning blade 34 on the front side. More specifically, when the headcap holder 63 is moved at the retract position, the second guide bearing 72 moves the curve part 69*d* of the second guide groove 69 with the first guide bearing 71 positioned at the front end of the tilt groove part 68*b* of the first guide groove 68. Therefore, the headcap holder 63 moves the headcap 5 at the cleaning position on the front side of the printer main body 2 as the headcap holder 63 tilts downward using the first guide bearing 71 as a support. At the cleaning position, an absorbing sheet is placed above the headcap 5, which absorbs ink attached to the cleaning blade 34, and the headcap 5 is moved to allow the cleaning blade 34 to be slid and contacted with the absorbing sheet. Therefore, the cleaning blade 34 can be cleaned to maintain the cleaning performance.

Figure 27:
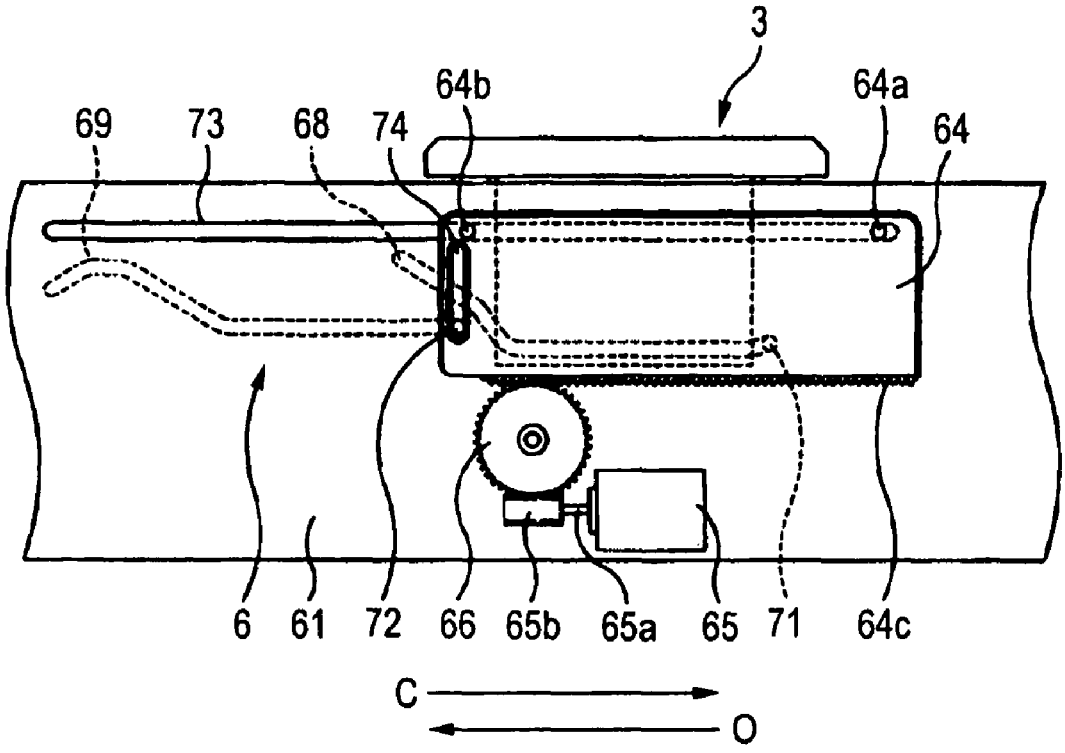
FIG. 27 shows a side view depicting a chassis side part and a rack plate.

As shown in FIG. 27, the side part 61 of the chassis which fixes the support frame member 62 is formed with a third guide groove 73 which is extended in the horizontal direction above the first guide groove 68 and the second guide groove 69 of the support frame member 62. In the third guide groove 73, a pair of cam pins 64*a* and 64*b* is locked which is separately disposed on the back side of the rack plate 64, described later, in the back-and-forth direction. The cam pins 64*a* and 64*b* are rotated, and then the third guide groove 73 guides the movement of the rack plate 64 in the back-and-forth direction along the side part 61.

The rack plate 64 whose movement is guided by the chassis side part 61 is formed in a nearly rectangular plate, having a rack 64*c* in the lower rim part nearly in the entire length. The rack 64*c* is geared with the worm gear 66 which is rotated and driven by the drive motor 65 mounted on the chassis side part 61. Therefore, the drive motor 65 activates the rack plate 64 to move along the chassis side part 61 through the cam pins 64*a* and 64*b* locked in the third guide groove 73.

In addition, the rack plate 64 has a cam groove 74 in the height direction on the front side. In the cam groove 74, the second guide bearing 72 disposed on the headcap holder 63 is locked as penetrating through the second guide groove 57. Thus, the movement of the second guide bearing 72 is guided in the vertical direction, and the headcap holder 63 can be moved along the first and second guide grooves 68 and 69 of the support frame member 62.

For the cap moving mechanism 6 thus configured, the drive motor 65 is driven based on a control signal from the control mechanism 7, described later, when the headcap 5 is moved from the initial state at the block position at which the head cartridge 4 is blocked to the open position at which the head cartridge 4 is opened in order to perform the print operation. When the worm gear 66 is rotated through an output shaft 65*a* and a foam 65*b* of the drive motor 65, the rack plate 64 locked in the worm gear 66 is moved to the front side of the printer main body 2 in the horizontal direction while the cam pins 64*a* and 64*b* are being guided by the third guide groove 73 formed on the chassis side part 61.

At this time, since the rack plate 64 is moved as it pulls the second guide bearing 72 locked in the cam groove 74, the headcap holder 63 disposed with the second guide bearing 72 is moved to the front side of the printer main body 2 in response to the movement of the rack plate 64. For the headcap holder 63, the first guide bearing 71 is moved along the first guide groove 68 of the support frame member 62, and the second guide bearing 72 is moved along the second guide groove 69 of the support frame member 62.

Since the second guide bearing 72 is moved along the third guide groove 73 formed on the rack plate 64 in the height direction, the headcap holder 63 is movable in the height direction, and the first and second guide bearings 71 and 72 are movable from the horizontal grooves 68*a* and 69*a* of the first and second guide grooves 68 and 69 to the tilt groove parts 68*b* and 69*b* formed on the support frame member 62. Thus, the headcap holder 63 is horizontally moved from the print position of the printer main body 2 to the front side, it is moved upward in the front side of the printer main body 2, and it is held as slightly tilt frontward depending on the shape of the printer main body 2. Accordingly, the headcap 5 held by the headcap holder 63 is moved from the block position of the head cartridge 4 to the open position, and it is retracted from the transfer area of the paper sheet P at the open position.

In addition, as described above, for the headcap 5, when the absorbing sheet is disposed which cleans the cleaning blade 34 at the retract position of the head cartridge 4, the wipe part 43 of the cleaning blade 34 is slid and contacted with the absorbing sheet in accordance with the operation of opening the head cartridge 4, whereby the attached ink can be absorbed. Thus, the cleaning blade 34 can be cleaned to maintain the cleaning performance.

When the headcap holder 63 is moved at the position at which the headcap 5 opens the head cartridge 4, the drive of the drive motor 65 is stopped, and the operation is shifted to the print operation. When the print operation is finished, the drive motor 65 is activated based on the control signal from the control mechanism 7, the headcap holder 63 is moved to the print position of the printer main body 2 in the reverse operation of the operation of opening the head cartridge 4 described above, and the headcap 5 is moved and returned to the block position of the head cartridge 4.

Figure 4:
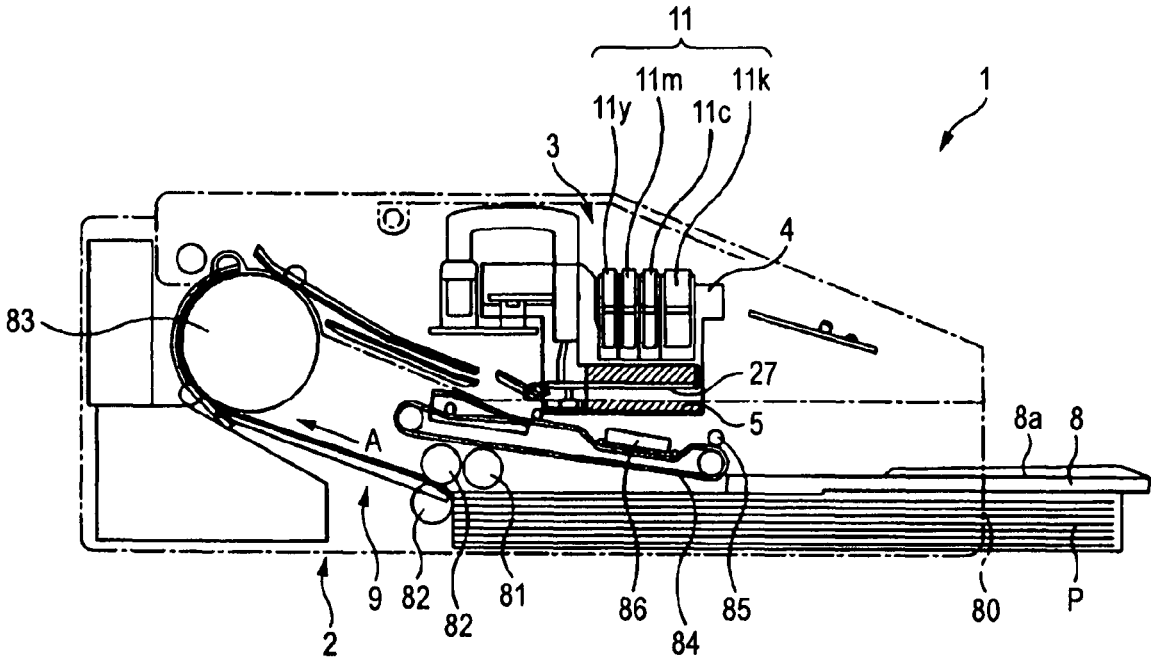
FIG. 4 shows a side view depicting the internal configuration of the printing apparatus.

Here, the paper feed and eject mechanism 9 which transfers the paper sheet P from the paper tray 8 into the printer main body 2, and after printing, ejects it onto the paper tray 8 will be described with reference to FIG. 4. The paper tray 8 which feeds paper sheets to the paper feed and eject mechanism 9 is mounted on the tray insertion port 80 disposed on the bottom of the front side of the printer main body 2, and thus it can feed the paper sheet P accommodated in the tray into the printer main body 2. Furthermore, the paper tray 8 is formed with an ejected paper receiving part 8*a* on the top side onto which the paper sheet P printed by the printing apparatus 1 is ejected.

The paper feed and eject mechanism 9 has the paper feed roller 81 which feeds paper sheets accommodated in the paper tray 8 into the printer main body 2, a separation roller 82 which separates the paper sheet P sheet by sheet, the reverse roller 83 which reveres the transfer direction of the paper sheet P on the head cartridge 4 side, a carrier belt 84 which carries the paper sheet P from the head cartridge 4 to the front side of the printer main body 2, and a paper output roller 85 which outputs the printed paper sheet P onto the ejected paper receiving part 8*a*.

The paper feed roller 81 takes the paper sheets P before printed layered and accommodated in the paper tray 8 mounted on the tray insertion port 80 out of the paper tray 8, and transfers it to the back side of the printer main body 2. A pair of the separation rollers 82 is disposed near the paper feed roller 81 on the downstream side in the transfer direction of the paper sheet P, which transfers only one sheet of the layered and accommodated paper sheets P to the reverse roller 83. The reverse roller 83 reveres the transfer direction of the paper sheet P transferred on the back side of the printer main body 2, and transfers the paper sheet P to the under side of the head cartridge 4. The carrier belt 84 is positioned under the head cartridge 4, which holds the paper sheet P under the head cartridge 4, and derivers the printed paper sheet P from the under side of the head cartridge 4 to the front side of the printer main body 2. The paper output roller 85 ejects the paper sheet P onto the ejected paper receiving part 8*a* formed on the top side of the paper tray 8.

Although the detail is omitted, the printing apparatus 1 has a circulating pump mechanism which circulates the ink i between the ink accommodating part 13 and the head cartridge 4 of the ink cartridge 11. The circulating pump mechanism is provided to remove bubbles in the head cartridge 4 in order to prevent print quality from deteriorating due to the discharge of the ink i in the state in which bubbles are mixed in the ink passage 31 and the ink liquid chamber 32. For example, the circulating pump mechanism is formed in which the ink accommodating part 13 of the ink cartridge 11 is joined to the ink passage 31 formed in the head cartridge 4 with an ink reflux tube formed of a flexible resin tube through a circulating pump. The ink reflux tube is connected to the both ends of the ink passage 31 for each color disposed on the head cartridge 4, that is, the both ends of the common ink passage 31 formed in the longitudinal direction of the head cartridge 4, and is connected to the both ends in the longitudinal direction of the cartridge tank 12 mounted on the cartridge mounting part 22. The circulating pump disposed in the midway of the ink reflux tube is a pressure generator for suction and deliver to circulate the ink i between the ink passage 31 of the head cartridge 4 and the ink accommodating part 13 of the ink cartridge 11, for which a diaphragm pump is used, for example.

The circulating pump mechanism is driven at the time when the printing apparatus 1 is activated or before starting printing, which sucks the ink i from the ink passage 31 of the head cartridge 4 by the circulating pump, and derivers the ink to the ink accommodating part 13 of the ink cartridge 11. At this time, since the ink is circulated to flow from the center of the ink passage 31 to the both ends in the head cartridge 4, bubbles in the ink passage 31 are driven away to the both ends, put into the ink accommodating part 13 of the ink cartridge 11, and then released to air from the external communicating hole 15. Therefore, the circulating pump mechanism can remove bubbles in the ink i.

Figure 28:
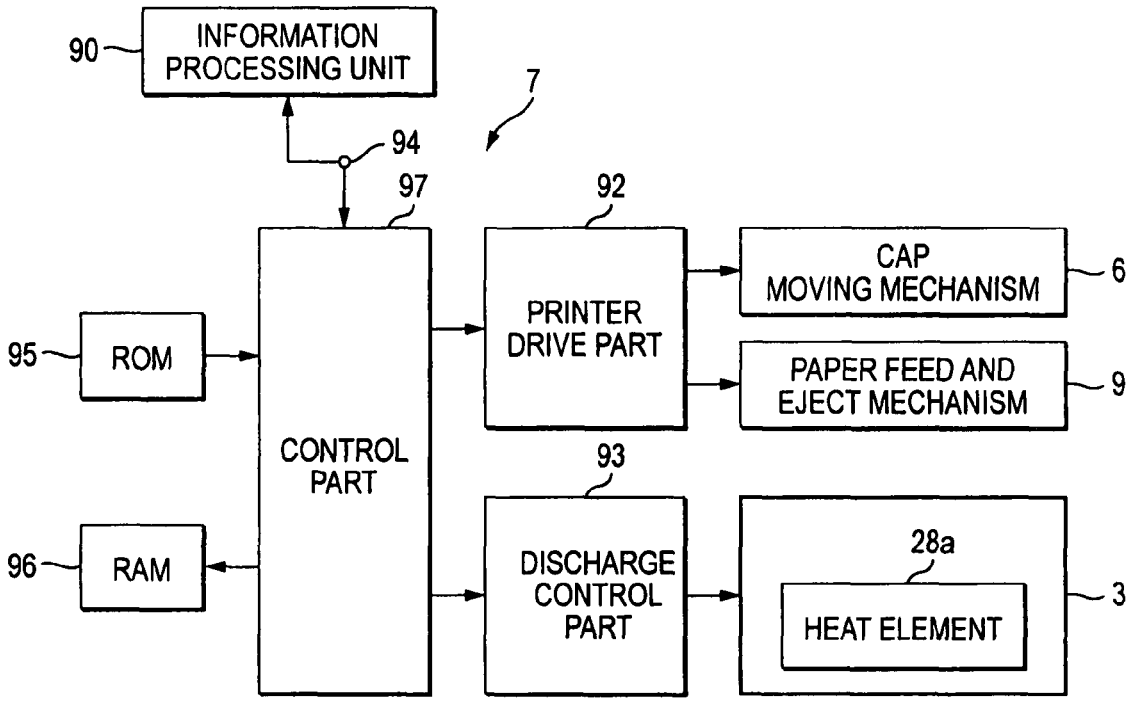
FIG. 28 shows a block diagram depicting a control mechanism.

The printing apparatus 1 thus configured is controlled by the control mechanism 7 based on print data inputted from an information processing unit 90 externally disposed. FIG. 28 shows a block diagram illustrative of the configuration and operation of the control mechanism 7. The control mechanism 7 has a control circuit 91 which controls the printing in the printing apparatus 1. The control circuit 91 has a printer drive part 92 which controls the drive of the paper feed and eject mechanism 9 and the cap moving mechanism 6 of the printer main body 2, a discharge control part 93 which controls current supplied to the ink discharge head 3 or the like, an I/O terminal 94 which inputs and outputs signals with the information processing unit 90, a ROM (Read Only Memory) 95 in which control programs are recorded, a RAM (Random Access Memory) 96 which temporarily stores the read control program or the like and reads it as necessary, and a control part 97 which controls each part.

The printer drive part 92 controls the cap moving mechanism 6 in which it drives the drive motor 65 of the cap moving mechanism 6 based on the control signal from the control part 97, and moves the headcap 5 to open and close the ink discharge area 27. Furthermore, the printer drive part 92 controls the paper feed and eject mechanism 9 in which it drives the drive motor configuring the paper feed and eject mechanism 9 based on the control signal from the control part 97, feeds and transfers the paper sheet P from the paper tray 8 mounted on the tray insertion port 80 of the printer main body 2 inside the apparatus at a predetermined transfer rate, and ejects the paper sheet P out of the tray insertion port 80 after printing.

The discharge control part 93 selectively carries pulse current through the heat element 28*a* based on the control signal from the control part 97, and drives and controls the heat element 28*a* at a predetermined frequency.

The I/O terminal 94 inputs and outputs signals for the print conditions, the print state, and the ink remaining quality, for example, to the external information processing unit 90. Here, for example, the information processing unit 90 is an electronic appliance such as a personal computer and a PDA (Personal Digital Assistant).

The ROM 95 is a memory which stores process programs executed by the control part 97 therein. The stored programs are loaded in the RAM 96 by the control part 97. The RAM 96 stores therein a program read out of the ROM 95 by the control part 97 and various states of the printing apparatus 1.

For example, the control part 97 is a CPU (Central Processing Unit), which drives each part to print in accordance with print data based on the program loaded in the RAM 96. The control part 97 indicates warnings by receiving information from the ink remaining quantity detecting part 24, and manages the number of sheets for printing and the elapsed time after starting printing to make various indications to notice the occasions to clean and exchange the headcap 5.

Figure 29:
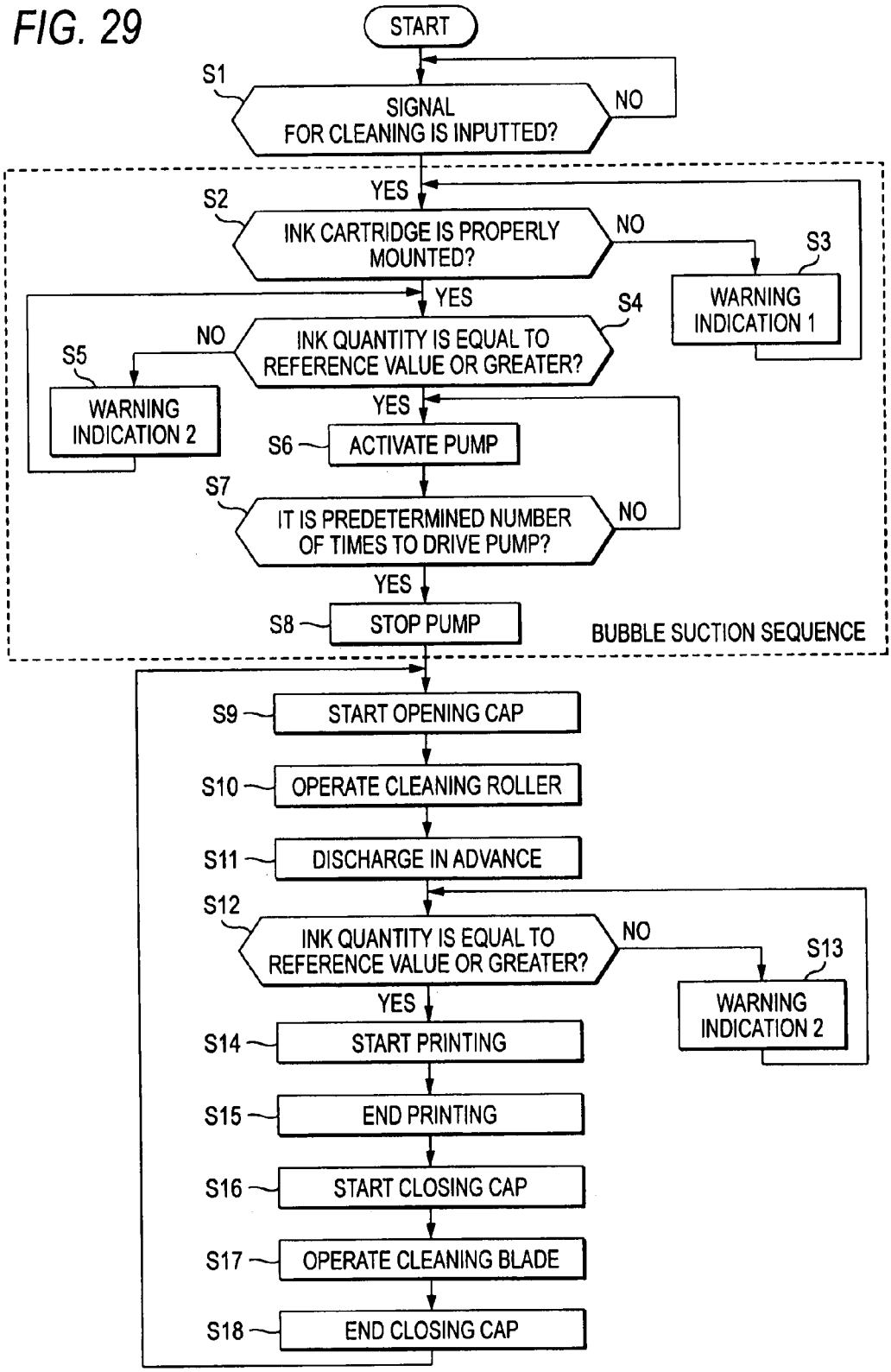
FIG. 29 shows a flow chart depicting an operation sequence of the printing apparatus.
Figure 32A:
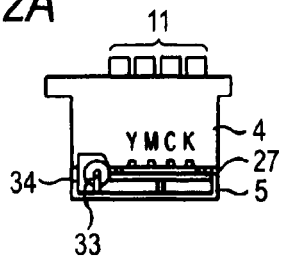
FIG. 32A to 32J show operation charts depicting an operation sequence of the printing apparatus.
Figure 32B:
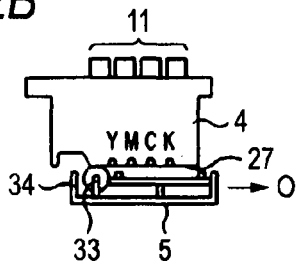
Figure 32C:
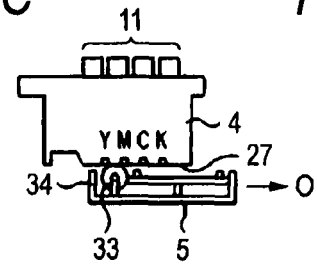
Figure 32D:
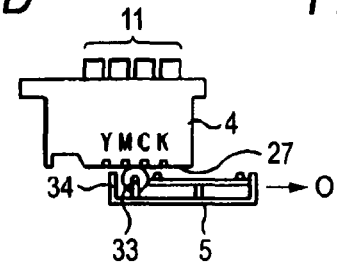
Figure 32E:
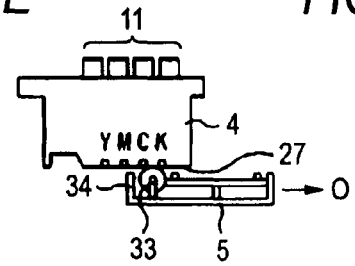
Figure 32F:
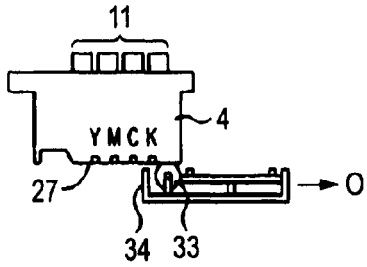

Next, the specific operation sequence of the printing apparatus 1 to which an embodiment of the invention is adapted will be described with reference to FIGS. 29 and 32. As shown in FIG. 32A, when a manipulation button disposed on the printer main body 2 is operated to instruct the control part 97 to start printing during standby in the initial state in which the headcap 5 blocks the head cartridge 4, the printing apparatus 1 drives the paper feed and eject mechanism 9 and the cap moving mechanism 6 as below and puts them into the state to allow printing based on the control signal from the control part 97.

First, the printing apparatus 1 performs maintenance such as the cleaning of the ink discharge area 27 prior to printing and the detection of the ink remaining quality. More specifically, when a cleaning signal is sent at Step 1, the control part 97 determines whether the ink cartridges 11*y*, 11*m*, 11*c*, and 11*k* are correctly mounted at Step 2. When it is determined that any one of them is not correctly mounted in the ink cartridge 11, the control part 97 displays a warning at a predetermined place of the printer main body 2 (Step 3).

At Step 4, the control part 97 receives a signal from the ink remaining quantity detecting part 24 to determine the remaining quantity of the ink i accommodated in the ink accommodating part 13 of the ink cartridge 11. When the ink remaining quantity is smaller than the reference value, the control part 97 displays a warning at a predetermined place of the printer main body 2 (Step 5).

At Step 6, the control part 97 activates the circulating pump mechanism to suck the ink i flowing through the ink passage 31 of the head cartridge 4 by the circulating pump, and derivers the ink into the ink accommodating part 13 of the ink cartridge 11, whereby bubbles in the ink i are removed. The control part 97 determines whether the circulating pump is driven for a predetermined number of times. When the number of times to drive the circulating pump reaches a predetermined number of times, it stops the circulating pump mechanism (Step 7, Step 8).

Subsequently, at Step 9, the control part 97 sends a signal to the printer drive part 92 to drive the cap moving mechanism 6, whereby the headcap 5 is moved with respect to the head cartridge 4 on the front side of the printer main body 2 on which the paper tray 8 is disposed, as shown in FIGS. 32B to 32F. Therefore, in the printing apparatus 1, the ink discharge nozzles 26 disposed in the ink discharge area 27 of the ink discharge head 3 are exposed outside to discharge the ink i.

Here, the cleaning roller 33 and the cleaning blade 34 are disposed in the headcap 5, in which the cleaning roller 33 is slidably supported over the ink discharge area 27, and the cleaning blade 34 is retracted from the ink discharge area 27 by the switching member 35. Thus, when the headcap 5 is moved in the arrow O direction in FIGS. 11 and 14 in which the headcap 5 opens the ink discharge area 27 of the head cartridge 4, the cleaning roller 33 receives the energizing force of the coil spring 38 and is driven and rotated while it presses the ink discharge area 27 at moderate pressure in the entire length in the longitudinal direction, and it cleans waste and the ink hardened with increased viscosity attached to the ink discharge nozzles 26 and the ink discharge area 27 (Step 10).

At this time, the cleaning roller 33 has excellent wettability to the ink because the outer layer contacted with the ink discharge area 27 is soaked in a surface active agent solution. Upon the cleaning roller 33 being contacted with the ink discharge nozzles 26, the ink layer is instantaneously formed between the cleaning roller 33 and the ink discharge area 27, and the ink in the layer again solves the ink with increased viscosity to reduce the viscosity. The ink with reduced viscosity is absorbed by the cleaning roller 33 with high wettability to improve the cleaning effect by the cleaning roller 33.

Accordingly, upon the opening operation of the headcap 5, the cleaning roller 33 surely removes the thickened ink and waste attached to the ink discharge nozzles 26 and the ink discharge area 27. Therefore, the ink discharge nozzles 26 discharge the ink drops straight, and the liquid discharge performance of the head cartridge 4 can be stabilized.

Furthermore, the switch 51 of the switching member 35 is pressed by the ink discharge area 27 and is rotated in an arrow S direction in reverse in FIG. 11, whereby the holder 45 is pressed by the other side surface 51*b* of the switch 51 to rotate the cleaning blade 34 in an arrow R direction in reverse in FIG. 11, and the wipe part 43 is retracted from the ink discharge area 27. Therefore, after cleaned by the cleaning roller 33, the excessive slide of the cleaning blade 34 is suppressed. Thus, the ink discharge nozzles 26 and the ink discharge area 27 can be protected as well as the cleaning blade 34 can be prevented from deteriorating.

In addition, the ink absorbed in the cleaning roller 33 is sucked by the scraper 48, and then absorbed by the absorbing member 49. Therefore, the cleaning roller 33 can maintain the cleaning performance without saturating the absorbed ink.

In addition, the control part 97 sends a control signal to the discharge control part 93 to sequentially discharge in advance the ink i from the ink discharge nozzles 26 having cleaned by the cleaning roller 33 (Step 11). The discharge in advance is performed in order to condition the discharge performance in the ink discharge nozzles 26 from which thickened ink is absorbed by the cleaning roller 33. It is performed in which liquid drops of the ink i are sequentially discharged in order of the nozzle lines 26*y*, 26*m*, 26*c*, and 26*k* having cleaned by the cleaning roller 33 onto the waste ink tray formed of a moisture absorption material sheet disposed between the cleaning roller 33 and the cleaning blade 34.

After the discharge in advance, at Step 12, the control part 97 again detects each of the remaining quantity of the ink i accommodated in the ink cartridge 11. When the ink remaining quantity is smaller than the reference value, it is controlled to display a warning at a predetermined place of the printer main body 2 (Step 13).

When an amount of the ink equal to the reference value or greater remains in the ink cartridge 11 after the discharge in advance, the print operation is started (Step 14). More specifically, the control part 97 sends a control signal to the printer drive part 92 to drive the paper feed and eject mechanism 9. The paper feed and eject mechanism 9 pulls the paper sheets P out of the paper tray 8 with the paper feed roller 81, transfers only one paper sheet P to the reverse roller 83 by a pair of the separation rollers 82*a* and 82*b* rotated in the reverse directions to each other, reveres the transfer direction on the ink discharge area 27 side by the reverse roller 83, and transfers the paper sheet P on the carrier belt 84 disposed at the position opposite to the ink discharge area 27. The printing apparatus 1 supports the paper sheet P transferred on the carrier belt 84 at the print position by the platen plate 86, and faces the paper sheet P to the ink discharge area 27 in parallel. In the printing apparatus 1, the paper sheet P is transferred by the paper feed and eject mechanism 9 at a predetermined transfer rate, for example, 49.5 mm/sec or faster.

Figure 32G:
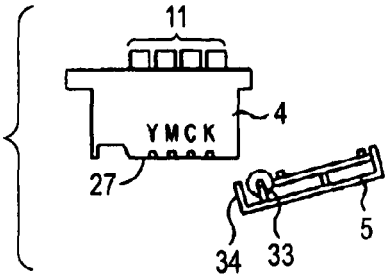
Figure 32H:
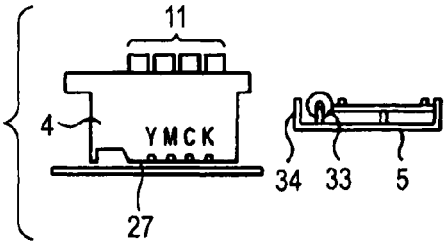

In addition, as shown in FIGS. 32G and 32H, the headcap 5 is retracted from the transfer area of the paper sheet P by this time, and the carrier belt 84 and the platen plate 86 are elevated which have waited below.

Subsequently, in the printing apparatus 1, the discharge control part 93 is driven by the control signal from the control part 97, pulse current is selectively carried through the heat element 28*a* of the head cartridge 4 at a predetermined frequency, for example, 9 kHz or greater, and the heat element 28*a* is heated. As shown in FIGS. 8A and 8B, in the printing apparatus 1, the heat element 28*a* is heated to form and discharge the ink i in each color in fine liquid drops through the ink discharge nozzles 26, and images and characters formed of ink dots are printed in multi color on the paper sheet P transferred at the position opposite to the ink discharge area 27.

Subsequently, in the printing apparatus 1, the printed paper sheet P is delivered onto the ejected paper receiving part 8*a* of the paper tray 8 by the carrier belt 84 which rotates the paper sheet P in the direction of the paper tray 8 and the paper output roller 85 which faces the carrier belt 84 and is disposed on the paper tray 8 side of the paper feed and eject mechanism 9.

Figure 32I:
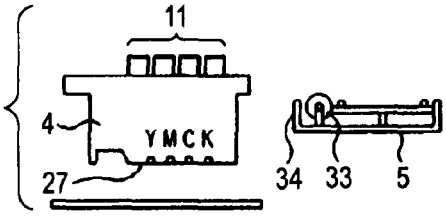
Figure 32J:
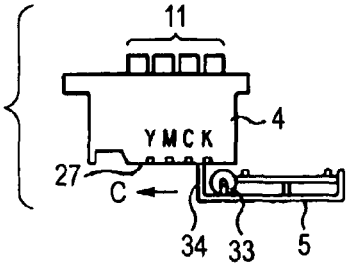

At Step 15, when the print operation is finished, a headcap close trigger signal is inputted. As shown in FIG. 32I, the carrier belt 84 and the platen plate 86 are retracted at the position lower than the moving area of the headcap 5, and as shown in FIGS. 16 and 32J, the headcap 5 is moved through the trace indicated in the arrow C direction of the head cartridge 4 (Step 16). At this time, the switch 51 is pressed by the ink discharge area 27 to rotate the switching member 35 disposed on the headcap 5 in an arrow S direction in FIG. 11. Accordingly, for the cleaning blade 34, the holder 45 received with the energizing force of the helical torsion spring 46 is rotated in an arrow R direction in FIG. 11, and the wipe part 43 can be slid and contacted with the ink discharge area 27. Therefore, the headcap 5 is moved in the block direction in which the headcap 5 blocks the head cartridge 4, and the cleaning blade 34 cleans the ink and waste attached on the ink discharge area 27 (Step 17).

In addition, in the switching member 35, the one side surface 51*a* of the switch 51 presses the plug 36 of the cleaning roller 33 downward to retract the cleaning roller 33 from the ink discharge area 27. More specifically, the cleaning roller 33 does not clean the ink discharge area 27 at the time when the headcap 5 is returned at the original position. More specifically, as described above, when the cleaning roller 33 is driven and rotated or slid over the ink discharge area 27 after printing, the unused ink stored in the ink liquid chamber 32 is unnecessarily absorbed causing excessive costs, and the absorbing performance of the cleaning roller 33 is deteriorated to shorten the lifetime of the cleaning roller 33 which is a consumable item. After that, as shown in FIGS. 13 and 32A, the headcap 5 is returned to the original position, and is again mounted on the head cartridge 4 to protect the ink discharge area 27 from drying, for example (Step 18).

Figure 30:
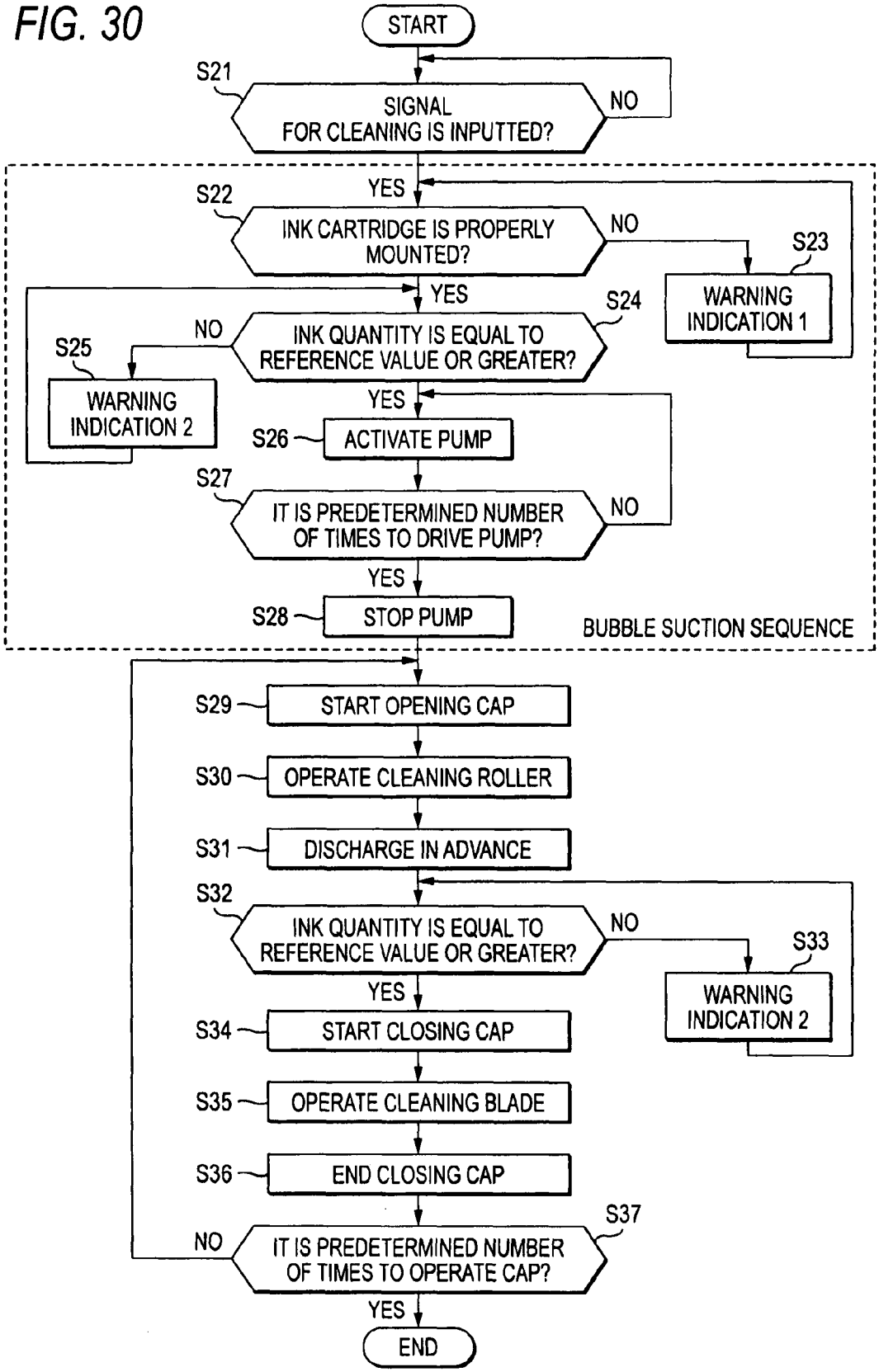
FIG. 30 shows a flow chart depicting another operation sequence of the printing apparatus.

Next, another exemplary operation sequence of the printing apparatus 1 to which an embodiment of the invention is adapted will be described with reference to FIGS. 30 and 32. The cleaning sequence shown in FIG. 30 is the operation in which the number of times of the cleaning operation of the headcap 5 is varied depending on the operation mode of the printing apparatus 1. For example, the operation mode of the printing apparatus 1 is various states in which it is necessary to clean the head cartridge 4 such as the time when the printing apparatus 1 is activated, the time right after the ink cartridge 11 or the head cartridge 4 or the headcap 5 is replaced, the time in the copy mode in which prints are continued for a predetermined number of sheets in monochrome printing, and the time when an operator of the printing apparatus 1 is desired. Then, in the printing apparatus 1, the open/close operation of the head cartridge 4 done by the headcap 5 is repeated for a predetermined number of times depending on each mode to clean the headcap 4.

More specifically, as shown in FIG. 30, in the printer main body 2, the operation modes, and the timing and the number of times of cleaning the head cartridge 4 are managed by the control part 97. When it is the timing of cleaning the head cartridge 4 as described above, the control part 97 sends a cleaning signal (Step 21). The maintenance process steps prior to the subsequent cleaning operation, that is, the process steps including whether the ink cartridge 11 in each color is mounted, whether the ink remaining quantity in the ink cartridge 11 is sufficient, and the removal of bubbles in the ink i by the circulating pump mechanism (Step 22 to Step 28) are performed as similar to Steps 1 to 8 described above.

Subsequent to the maintenance process steps, the process goes to the cleaning process steps. In the cleaning process steps, as shown in FIGS. 32B to 32H, the control part 97 sends a signal to the printer drive part 92 to drive the cap moving mechanism 6, and the headcap 5 is moved on the front side of the printer main body 2 at which the paper tray 8 is disposed with respect to the head cartridge 4 (Step 29).

At this time, the cleaning roller 33 disposed on the headcap 5 receives the energizing force of the coil spring 38, and is driven and rotated while it is pressing the ink discharge area 27 at moderate pressure, and waste and the ink hardened with increased viscosity attached to the ink discharge nozzles 26 and the ink discharge area 27 are cleaned (Step 30). The cleaning roller 33 has excellent wettability to the ink because the outer layer contacted with the ink discharge area 27 is soaked in a surface active agent solution. Upon the cleaning roller 33 being contacted with the ink discharge nozzles 26, the ink layer is instantaneously formed between the cleaning roller 33 and the ink discharge area 27, and the ink in the layer again solves the ink with increased viscosity to reduce the viscosity. The ink with reduced viscosity is absorbed in the cleaning roller 33 with high wettability to improve the cleaning effect by the cleaning roller 33.

Furthermore, the switch 51 of the switching member 35 is pressed by the ink discharge area 27 and is rotated in the reverse direction of the arrow S in FIG. 11, whereby the holder 45 is pressed by the other side surface 51*b* of the switch 51 to rotate the cleaning blade 34 disposed on the headcap 5 in the reverse direction of the arrow R in FIG. 11, and the wipe part 43 is retracted from the ink discharge area 27. Therefore, after cleaned by the cleaning roller 33, the excessive slide of the cleaning blade 34 is suppressed. Thus, the ink discharge nozzles 26 and the ink discharge area 27 can be protected as well as the cleaning blade 34 can be prevented from deteriorating.

In addition, the control part 97 sends a control signal to the discharge control part 93 to discharge in advance the ink i from the ink discharge nozzles 26 having cleaned by the cleaning roller 33 (Step 31). The discharge in advance is performed in order to condition the discharge performance in the ink discharge nozzles 26 from which thickened ink is absorbed in the cleaning roller 33. It is performed in which liquid drops of the ink i are sequentially discharged in order of the nozzle lines 26*y*, 26*m*, 26*c*, and 26*k* having cleaned by the cleaning roller 33 onto the waste ink tray formed of a moisture absorption material sheet disposed between the cleaning roller 33 and the cleaning blade 34.

After the discharge in advance, at Step 32, the control part 97 again detects each of the remaining quantity of the ink i accommodated in the ink cartridge 11. When the ink remaining quantity is smaller than the reference value, it is controlled to display a warning at a predetermined place of the printer main body 2 (Step 33).

At Step 34, after the ink remaining quantity is detected, a headcap close trigger signal is inputted. As shown in FIG. 32J, the headcap 5 is moved through the trace indicated in the arrow C direction (Step 34). At this time, the switch 51 is pressed by the ink discharge area 27 to rotate the switching member 35 disposed on the headcap 5 in an arrow S direction in FIG. 11. Accordingly, for the cleaning blade 34, the holder 45 received with the energizing force of the helical torsion spring 46 is rotated in an arrow R direction in FIG. 11, and the wipe part 43 can be slid and contacted with the ink discharge area 27. Therefore, the headcap 5 is moved in the block direction in which the headcap 5 blocks the head cartridge 4, and the cleaning blade 34 cleans the ink and waste attached on the ink discharge area 27 (Step 35).

In addition, in the switching member 35, the one side surface 51*a* of the switch 51 presses the plug 36 of the cleaning roller 33 downward to retract the cleaning roller 33 from the ink discharge area 27. More specifically, the cleaning roller 33 does not clean the ink discharge area 27 at the time when the headcap 5 is returned to the original position because of the reason described above. After that, as shown in FIGS. 13 and 32A, the headcap 5 is returned to the original position, and is again mounted on the head cartridge 4 to protect the ink discharge area 27 from drying, for example (Step 36).

The control part 97 manages the number of times to perform the cleaning operation, and determines whether the reciprocating operation of the headcap 5 is performed for a predetermined number of times depending on the operation mode, that is, whether the cleaning roller 33 and the cleaning blade 34 clean the head cartridge 4 (Step 37). The number of times to clean the head cartridge 4 is varied depending on the operation mode, which is programmed in the ROM 95 in advance. For example, it is performed for three times when the printing apparatus 1 is activated (the headcap 5 reciprocates three times), it is performed for ten times right after the ink cartridge 11 or the head cartridge 4 or the headcap 5 is replaced (the headcap 5 reciprocates ten times), and it is performed for ten times when an operator of the printing apparatus 1 is desired (the headcap 5 reciprocates ten times). The relation between the number of times to clean the head cartridge 4 by reciprocating the headcap 5 and the operation mode is properly set.

The control part 97 controls the reciprocating operation of the headcap 5 until it reaches the number of times to reciprocate the headcap 5 depending on the operation mode. Accordingly, in the printing apparatus 1, the head cartridge 4 is properly cleaned as necessary. Thus, the ink discharge nozzles 26 and the ink discharge area 27 can be kept cleaned all the time, and the stable ink discharge performance can be maintained.

Figure 31:
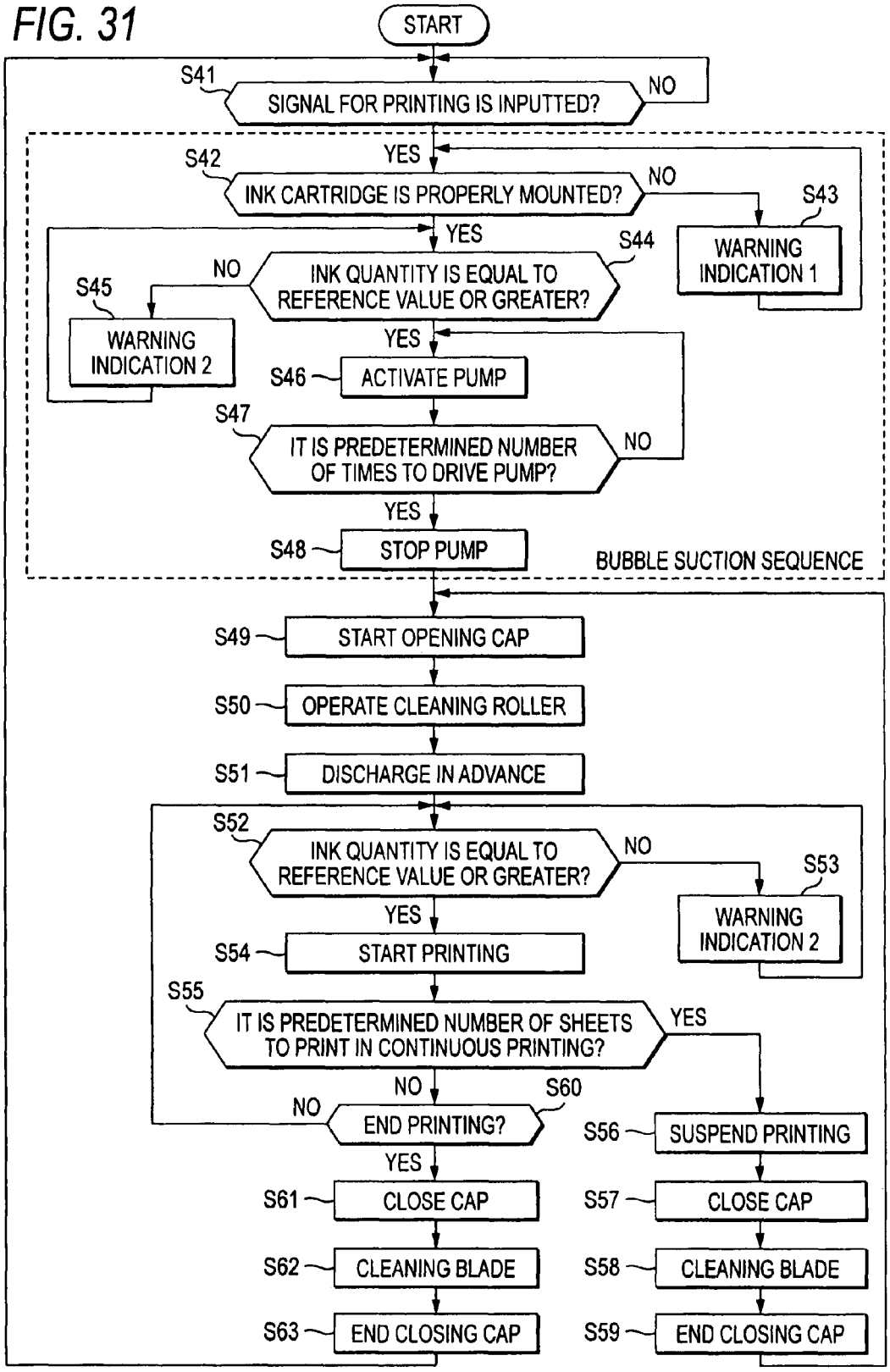
FIG. 31 shows a flow chart depicting still another operation sequence of the printing apparatus.

Next, still another exemplary operation sequence of the printing apparatus 1 to which an embodiment of the invention is adapted will be described with reference to FIGS. 31 and 32. The cleaning sequence shown in FIG. 31 is the operation in which after the printing apparatus 1 starts printing, the head cartridge 4 is cleaned at the stage in which a predetermined number of sheets is printed. More specifically, after the headcap 5 opens the area, a nozzle sometimes discharges ink drops after a while depending on the ink discharge nozzles 26. It is sometimes difficult to do normal ink discharge because the ink in the nozzle has increased viscosity until ink is discharged, or because waste such as paper dust is attached to the ink discharge area 27. On this account, in the printing apparatus 1, the control part 97 manages the number of sheets to be printed in which after the print operation is started, the print operation is suspended at the stage in which a predetermined number of sheets is printed, and the head cartridge 4 is periodically cleaned.

More specifically, as shown in FIG. 31, when an operator operates to start printing, the control part sends a print signal to the printer main body 2 (Step 41). The maintenance process steps prior to the subsequent cleaning operation, that is, the process steps including whether the ink cartridge 11 in each color is mounted, whether the ink remaining quantity in the ink cartridge 11 is sufficient, and the removal of bubbles in the ink i by the circulating pump mechanism (Step 42 to Step 48) are performed as similar to Steps 1 to 8 described above.

Subsequent to the maintenance process steps, the process goes to the print process steps. In the print process steps, as shown in FIGS. 32B to 32H, the control part 97 sends a signal to the printer drive part 92 to drive the cap moving mechanism 6, and the headcap 5 is moved on the front side of the printer main body 2 at which the paper tray 8 is disposed with respect to the head cartridge 4 (Step 49).

At this time, the cleaning roller 33 disposed on the headcap 5 receives the energizing force of the coil spring 38, and is driven and rotated while it is pressing the ink discharge area 27 at moderate pressure, and waste and the ink hardened with increased viscosity attached to the ink discharge nozzles 26 and the ink discharge area 27 are cleaned (Step 50). The cleaning roller 33 has excellent wettability to the ink because the outer layer contacted with the ink discharge area 27 is soaked in a surface active agent solution. Upon the cleaning roller 33 being contacted with the ink discharge nozzles 26, the ink layer is instantaneously formed between the cleaning roller 33 and the ink discharge area 27, and the ink in the layer again solves the ink with increased viscosity to reduce the viscosity. The ink with reduced viscosity is absorbed in the cleaning roller 33 with high wettability to improve the cleaning effect by the cleaning roller 33.

Furthermore, the switch 51 of the switching member 35 is pressed by the ink discharge area 27 and is rotated in the reverse direction of the arrow S in FIG. 11, whereby the holder 45 is pressed by the other side surface 51*b* of the switch 51 to rotate the cleaning blade 34 disposed on the headcap 5 in the reverse direction of the arrow R in FIG. 11, and the wipe part 43 is retracted from the ink discharge area 27. Therefore, after cleaned by the cleaning roller 33, the excessive slide of the cleaning blade 34 is suppressed. Thus, the ink discharge nozzles 26 and the ink discharge area 27 can be protected as well as the cleaning blade 34 can be prevented from deteriorating.

In addition, the control part 97 sends a control signal to the discharge control part 93 to discharge in advance the ink i from the ink discharge nozzles 26 having cleaned by the cleaning roller 33 (Step 51). The discharge in advance is performed in order to condition the discharge performance in the ink discharge nozzles 26 from which thickened ink is absorbed by the cleaning roller 33. It is performed in which liquid drops of the ink i are sequentially discharged in order of the nozzle lines 26*y*, 26*m*, 26*c*, and 26*k* having cleaned by the cleaning roller 33 onto the waste ink tray formed of a moisture absorption material sheet disposed between the cleaning roller 33 and the cleaning blade 34.

After the discharge in advance, at Step 52, the control part 97 again detects each of the remaining quantity of the ink i accommodated in the ink cartridge 11. When the ink remaining quantity is smaller than the reference value, it is controlled to display a warning at a predetermined place of the printer main body 2 (Step 53).

When an amount of the ink equal to the reference value or greater remains in the ink cartridge 11 after the discharge in advance, the print operation is started (Step 54). More specifically, the control part 97 sends a control signal to the printer drive part 92 to drive the paper feed and eject mechanism 9 to pull and face the paper sheet P to the ink discharge area 27 in parallel. Subsequently, in the printing apparatus 1, the control signal from the control part 97 drives the discharge control part 93 to selectively carry pulse current through the heat element 28*a* of the head cartridge 4, and the heat element 28*a* is heated. As shown in FIGS. 8A and 8B, the printing apparatus 1 drives the heat element 28*a* to generate heat to form the ink i in each color in fine liquid drops through the ink discharge nozzles 26, and images and characters formed of ink dots are printed in multi color on the paper sheet P. Then, the paper sheet is delivered to the ejected paper receiving part 8*a* of the paper tray 8.

In the printing apparatus 1, the control part 97 determines whether the number of sheets to be printed reaches a predetermined number of sheets, three sheets, for example, from the cleaning operation right before, here, the opening operation of the headcap 5 at the time when printing is started (Step 55).

When the number reaches a predetermined number of sheets, the control part 97 suspends the print operation (Step 56). Then, the control part 97 sends a headcap close trigger signal to move the headcap 5 through the trace indicated in the arrow C direction as shown in FIGS. 16 and 32J (Step 57). At this time, for the cleaning blade 34 disposed on the headcap 5, the holder 45 having received the energizing force of the helical torsion spring 46 is rotated in an arrow R direction in FIG. 11, whereby the wipe part 43 is slid and contacted with the ink discharge area 27 to clean the ink and waste attached on the ink discharge area 27 (Step 58).

In addition, in the open/close operation of the head cartridge 4 done by the headcap 5, because of the reason described above, the switching member 35 presses the plug 36 of the cleaning roller 33 downward to retract the cleaning roller 33 from the ink discharge area 27. Therefore, the cleaning roller 33 does not clean the ink discharge area 27. After that, as shown in FIGS. 13 and 32A, the headcap 5 is returned to the original position at which the headcap 5 blocks the head cartridge 4 to end the open/close operation (Step 59).

Subsequently, the control part 97 sends a head cartridge open trigger signal to the printer drive part 92. As shown in FIGS. 32B to 32H, the cap moving mechanism 6 moves the headcap 5 on the front side of the printer main body 2 in which the headcap 5 opens the head cartridge 4 to restart the print operation via the cleaning by the cleaning roller 33, the discharge in advance, and the detection of the ink remaining quantity, described above (Step 49 to Step 54). Therefore, the head cartridge 4 having printed a predetermined number of sheets is cleaned for the ink discharge nozzles 26 and the ink discharge area 27. Thus, the stable ink discharge can be maintained, and print quality can be prevented from deteriorating.

After restarting printing, the control part 97 determines whether the number of sheets for continuous prints reaches a predetermined number of sheets from the cleaning operation right before, here, from the cleaning operation right before restarting printing (Step 55). It suspends printing at every time when the number reaches a predetermined number of sheets to clean by the opening and closing done by the headcap 5 described above. Therefore, the head cartridge 4 is periodically cleaned, whereby the ink discharge nozzles 26 and the ink discharge area 27 can be cleaned all the time, and stable print quality can be maintained.

During continuous prints, when the number of sheets to be printed does not reach a predetermined number of sheets necessary to clean, it is determined whether the print operation is finished (Step 60). When predetermined prints are not finished, each of the remaining quantity of the ink i accommodated in the ink cartridge 11 is detected (Step 53). When there remains an amount of ink equal to or greater than the reference value, the print operation is continued (Step 54).

On the other hand, when predetermined prints are finished at Step 60, the control part 97 sends a cap close trigger signal to the printer drive part 92, and the headcap 5 is moved through the trace in the arrow C direction as shown in FIGS. 16 and 32J (Step 61).

At this time, for the cleaning blade 34 disposed on the headcap 5, the holder 45 having received the energizing force of the helical torsion spring 46 is rotated in an arrow R direction in FIG. 11, whereby the wipe part 43 is slid and contacted with the ink discharge area 27 to clean the ink and waste attached on the ink discharge area 27 (Step 62).

In addition, in the open/close operation of the head cartridge 4 done by the headcap 5, because of the reason described above, the switching member 35 presses the plug 36 of the cleaning roller 33 downward to retract the cleaning roller 33 from the ink discharge area 27. Therefore, the cleaning roller 33 does not clean the ink discharge area 27. After that, as shown in FIGS. 13 and 32A, the headcap 5 is returned to the original position at which the headcap 5 blocks the head cartridge 4 to end the open/close operation (Step 63).

In addition, in the operation sequence, the number of sheets to be printed for cleaning the head cartridge 4 may be properly changed depending on the print mode such as color printing and monochrome printing. Furthermore, the number of times to reciprocate the headcap 5 in cleaning may be also properly set to a single or a multiple times depending on the print mode.

In addition, in the operation sequence, in addition to the scheme in which the head cartridge 4 is periodically cleaned depending on the number of sheets to be printed after cleaned, the reciprocating operation of the headcap 5 may be periodically performed to clean the head cartridge depending on the elapsed time after the head cartridge 4 is cleaned. In this case, the control part 97 manages the elapsed time after starting printing. It is controlled in which when a predetermined time period elapses, a paper sheet on printing is finished, and printing is suspended to clean the head cartridge 4. Thus, after the headcap 5 opens to start printing, even though a predetermined time period elapses to increase the viscosity of the ink in the ink discharge nozzles 26, or even though waste such as paper dust is attached to the ink discharge area 27, the head cartridge 4 is periodically cleaned to maintain it all the time.

In addition, also in the cleaning sequence of the head cartridge 4 in which it is cleaned depending on the elapsed time after starting printing, the elapsed time to clean the head cartridge 4 may be properly changed depending on the print mode such as color printing and monochrome printing. Furthermore, the number of times to reciprocate the headcap 5 in cleaning may be properly set depending on the print mode as well.

As described above, the printing apparatus 1 to which an embodiment of the invention is adapted has been described as the line scan head printing apparatus is taken as an example. However, an embodiment of the invention is not limited to the line scan head printing apparatus, for example, which may be adapted to a serial scan head liquid discharge apparatus in which an ink discharge head is moved in the direction nearly orthogonal to the running direction of a paper sheet P.

Furthermore, the ink cartridge 11 to which an embodiment of the invention is adapted has been described in the case in which it is mounted on the printing apparatus 1. However, an embodiment of the invention is not limited to the examples described above, and the ink cartridge can be widely mounted on the other pieces of liquid discharge apparatus which discharges liquid. For example, an embodiment of the invention can be adapted to a liquid cartridge which supplies liquid to a liquid discharge apparatus that discharges liquid, including an apparatus which discharges conductive particles such as a facsimile, a copy machine, a discharge apparatus for a DNA chip in liquid (see, JP-A-2002-253200), and an apparatus of forming a wiring pattern on a printed circuit board.

It should be understood by those skilled in the art that various modifications, combinations, sub-combinations and alterations may occur depending on design requirements and other factors insofar as they are within the scope of the appended claims or the equivalents thereof.

What is claimed is:

1. A cleaning blade which wipes a liquid discharge area by moving relatively with respect to the liquid discharge area of a liquid discharge head in which liquid discharge nozzles are arranged to discharge a liquid, the cleaning blade comprising:

a supporting plate which has an adhesive agent layer on its surface; and a wipe part which is slid and contacted with the liquid discharge area, the wipe part formed in which an elastic part formed of a synthetic resin is formed in one piece secured to the adhesive agent layer, and a tip end thereof is cut in a predetermined shape.

2. The cleaning blade according to claim 1, wherein the supporting plate and the wipe part are formed along an entire length in an arrangement direction of liquid discharge nozzles of the liquid discharge head in which the liquid discharge nozzles are matched with a print span of a liquid discharge target.

3. The cleaning blade according to claim 1, wherein the wipe part has slits in its tip end part at predetermined intervals.

4. The cleaning blade according to claim 1, wherein the wipe part has slits having a dimension that is less than a diameter of ink ejecting nozzles.

5. The cleaning apparatus for a liquid discharge head of a liquid discharge apparatus according to claim 1, wherein the wipe part has slits having a dimension that is less than a diameter of ink ejecting nozzles.

6. A cleaning apparatus for a liquid discharge head of a liquid discharge apparatus comprising:

the liquid discharge head having a liquid discharge area in which liquid discharge nozzles are arranged to discharge a liquid;

a cleaning blade which is slid and contacted with the liquid discharge area to wipe the liquid discharge area;

a moving mechanism which moves the cleaning blade with respect to the liquid discharge head; and a switching member which retracts the cleaning blade from a position at which the cleaning blade is slid and contacted with the liquid discharge area when the cleaning blade is moved to one side by the moving mechanism with respect to the liquid discharge head, and which returns the cleaning blade to a position at which the cleaning blade is slid and contacted with the liquid discharge area when the cleaning blade is moved to the other side by the moving mechanism with respect to the liquid discharge head, wherein the cleaning blade includes:

a supporting plate which has an adhesive agent layer on its front surface; and a wipe part which is slid and contacted with the liquid discharge area, the wipe part formed in which an elastic part formed of a synthetic resin is formed in one piece on the adhesive agent layer, and a tip end thereof is cut in a predetermined shape.

7. The cleaning apparatus for a liquid discharge head according to claim 6, wherein the supporting plate and the wipe part are formed long in accordance with the entire length in the arrangement direction of liquid discharge nozzles in the liquid discharge head in which the liquid discharge nozzles are arranged as matched with the print span of a liquid discharge target.

8. The cleaning apparatus for a liquid discharge head according to claim 6, wherein the wipe part has slits by forming cuts in its tip end part at predetermined intervals.

* * * * *